United States Patent [19]

Horodeck

[11] Patent Number: 4,544,276

[45] Date of Patent: Oct. 1, 1985

[54] METHOD AND APPARATUS FOR TYPING JAPANESE TEXT USING MULTIPLE SYSTEMS

[75] Inventor: Richard A. Horodeck, Ithaca, N.Y.

[73] Assignee: Cornell Research Foundation, Inc., Ithaca, N.Y.

[21] Appl. No.: 539,520

[22] Filed: Oct. 6, 1983

Related U.S. Application Data

[63] Continuation-in-part of Ser. No. 477,481, Mar. 21, 1983, abandoned.

[51] Int. Cl.[4] ..... B41J 5/30

[52] U.S. Cl. ..... 400/110; 400/484; 400/487; 178/30; 340/365 S; 340/711; 340/731; 364/900; 382/25

[58] Field of Search ..... 400/109, 110, 484, 487; 178/30; 340/146.3 AC, 365 S, 711, 731, 751; 364/900; 382/25

[56] References Cited

U.S. PATENT DOCUMENTS

| | | | |
|---|---|---|---|
| 1,204,326 | 11/1916 | Stickney | 400/110 X |
| 1,549,622 | 8/1925 | Stickney | 400/110 X |
| 1,600,494 | 9/1926 | Stickney | 400/110 X |
| 1,687,939 | 10/1928 | Jones | 400/110 X |
| 2,471,807 | 5/1949 | Yen | 400/110 |
| 3,541,511 | 11/1970 | Genchi et al. | 382/25 |
| 3,631,956 | 1/1972 | Choi | 400/110 X |
| 3,651,461 | 3/1972 | Holt | 340/146.3 AC |
| 3,665,450 | 5/1972 | Leban | 340/711 X |
| 3,778,819 | 12/1973 | Bhagawan et al. | 340/365 S |
| 3,809,203 | 5/1974 | Ogawa et al. | 400/110 |
| 3,809,204 | 5/1974 | Ogawa | 400/110 |
| 3,820,644 | 6/1974 | Yeh | 400/110 |
| 3,927,752 | 12/1975 | Jones et al. | 400/487 |
| 3,936,664 | 2/1976 | Sato | 400/110 X |
| 3,950,734 | 4/1976 | Li | 400/110 X |
| 3,970,991 | 7/1976 | Kawada et al. | 340/146.3 AC |
| 3,999,167 | 12/1976 | Ito et al. | 364/900 |
| 4,061,998 | 12/1977 | Ito | 340/146.3 AC |
| 4,079,482 | 3/1978 | Yeh | 400/110 X |
| 4,096,934 | 6/1978 | Kirmser et al. | 400/110 |
| 4,124,843 | 11/1978 | Bramson et al. | 400/109 X |
| 4,141,001 | 2/1979 | Suzuki et al. | 340/711 |
| 4,144,405 | 3/1979 | Wakamatsu | 400/110 X |
| 4,193,119 | 3/1980 | Arase et al. | 400/110 X |
| 4,228,507 | 10/1980 | Leban | 400/110 X |
| 4,251,871 | 2/1981 | Yu | 400/110 X |
| 4,270,022 | 5/1981 | Loh | 400/110 X |
| 4,327,421 | 4/1982 | Wang | 400/110 X |
| 4,375,922 | 3/1983 | Maegawa et al. | 400/110 X |

FOREIGN PATENT DOCUMENTS

| | | | |
|---|---|---|---|
| 0011528 | 2/1978 | Japan | 340/365 S |
| 0045527 | 4/1979 | Japan | 340/365 S |
| 0161832 | 12/1979 | Japan | 340/365 S |
| 0044612 | 3/1980 | Japan | 340/365 R |
| WO80/00105 | 1/1980 | PCT Int'l Appl. | 400/484 |
| WO82/00442 | 2/1982 | PCT Int'l Appl. | 400/484 |
| 1561654 | 2/1980 | United Kingdom | 400/110 |
| 2033633 | 5/1980 | United Kingdom | 400/110 |
| 2062916 | 5/1981 | United Kingdom | 400/110 |

OTHER PUBLICATIONS

IBM Technical Disclosure Bulletin, "Chinese Typewriter System", Dunham et al., vol. 19, No. 1, Jun. 1976, p. 320.

Review of the Electrical Communication Laboratories, "Kanji Input Device Using a Kana Keyboard", Horikawa, vol. 25, No. 3-4, Mar.-Apr. 1977, pp. 293-307.

*Primary Examiner*—Ernest T. Wright, Jr.

*Attorney, Agent, or Firm*—Jones, Tullar & Cooper

[57] ABSTRACT

A method and apparatus for typing Japanese text is disclosed. The method is characterized by operator manipulation of a keyboard to produce input signals to a microprocessor. The input signals are in the form of kana, English alphabet, numerals, and punctuation, as well as delimiting signals which may be used in combination with kana input to produce corresponding text material in kanji. The microprocessor is responsive to combinations of the kana input signals and delimiting code signals to produce adjusting outputs which call up from memory signals which produce the desired kanji output. A CRT display is provided for displaying keyboard signals and, when called for, kanji symbols from memory.

Where it is desired to type kanji symbols which cannot be called up by the operator through the use of kana and delimiting coding signals, alternative procedures using word analysis and graphic inputs are provided.

13 Claims, 9 Drawing Figures

Fig. 1
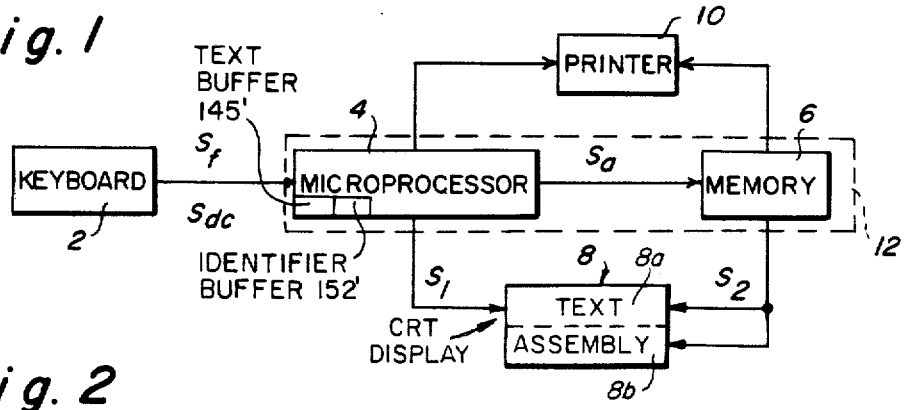
Fig. 2
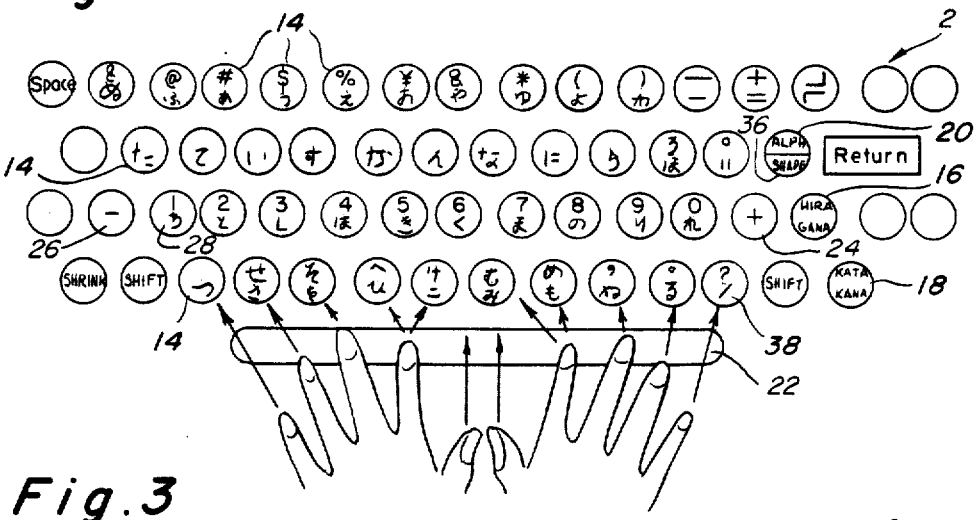
Fig. 3
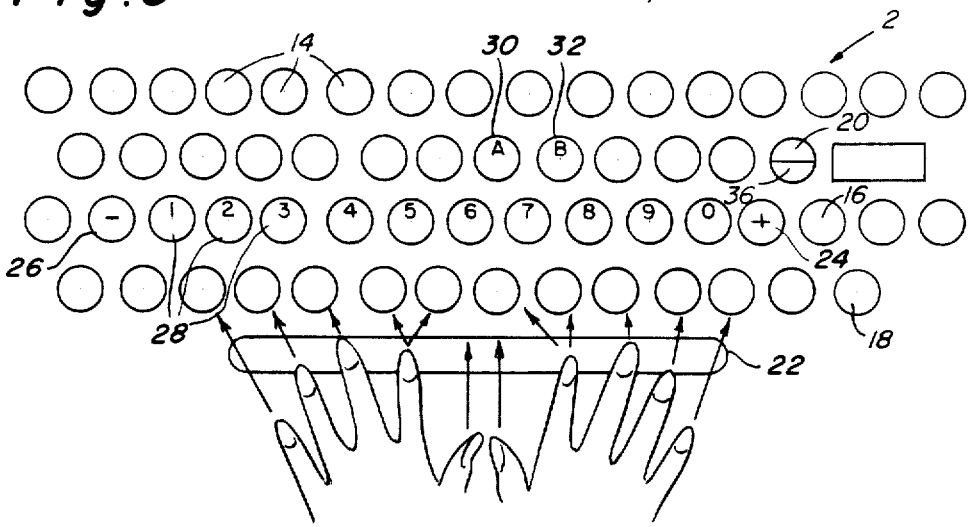
Fig. 5
| | |
|---|---|
| Fig. 4a | Fig. 4b |
| Fig. 4d | Fig. 4c |
| Fig. 4e | |

METHOD AND APPARATUS FOR TYPING JAPANESE TEXT USING MULTIPLE SYSTEMS

This application is a continuation-in-part of U.S. Ser. No. 477,481, filed Mar. 21, 1983 now abandoned.

BACKGROUND OF THE INVENTION

The present invention relates, in general, to a typewriter system for typing text material in the Japanese language and more particularly to a system for creating and/or copying text material using touch-typing techniques, wherein a portion of the text is typed directly by the operator, and the remainder is produced automatically by the system from memory in response to addressing command inputs by the operator.

The typing of the Japanese language presents unique problems since the written language is unusually complex in that it uses a mixture of four different symbol systems and more than three thousand symbols are required. This complexity has hindered the development of effective technology for creating and copying texts written in Japanese. Mechanical typewriters which provide key-driven type elements have been developed, but they are flawed in two ways. Either their designs are too complex or they are too simple. With a complex design, utilizing a keyboard on which all four symbol sets are mapped, an operator can produce normal looking texts, but cannot touch-type because he must hunt-and-peck the symbols for his text from among several thousand alternatives. A simple design, on the other hand, uses a keyboard on which only a small subset of symbols are mapped. An operator can touch-type, but cannot produce normal-looking texts; what he does produce is strange-looking because it is symbolically impoverished.

In comparison, alphabetic typewriters, such as those used for typing the English language, enable operators to produce normal-looking texts as well as to make use of touch-typing techniques. Furthermore, such typewriters have the flexibility to accommodate novices who hunt-and-peck and experts who touch-type equally well. This is so because the knowledge an operator acquires early in his education relating to the rules of spelling and punctuation, and which are incorporated into other activities, are used in operating the typewriter, and these knowledges, together with practice, are all that are required to become an expert with such typewriters.

A typing system that duplicates the flexibility of alphabetic typewriters and at the same time produces a normal-looking product is needed for the Japanese language. Although much of the technology to make such a system operable is now available and has been used to produce automated typing systems for the Japanese language, presently available systems remain inadequate. For example, some existing systems rely on codes which must be memorized for each symbol, the codes being typed one by one into the system to identify the symbols to be produced in a text. With such systems, operators can touch-type and can produce normal-looking written text; on the other hand, they must undergo lengthy special training before they can use the system, and must practice constantly in order to maintain their skill. Such systems not only may be fatiguing, but are completely unintelligible to the novice typist, and thus they are not easily usable by various typists having a wide range of skill levels.

Other available systems oversimplify the operator's job. Operators are required to type only the phonetic equivalent of the text to be produced, and to identify which segments are to be represented by one symbol subset or another in the written text. The system does the rest. Operators can touch-type for short stretches and produce normal-looking written text material; however, the input produced by the typist is often ambiguous and the system can only make an educated guess, often based on a frequency count, concerning the intended symbol. Therefore, operators are forced to monitor the system continually, and often must interrupt their typing in order to correct the mistakes made by the system. This is a source of fatigue, and also prevents operators from ever being able to touch-type uninhibitedly.

Any Japanese sentence can be spelled out with either of two types of Japanese phonetic symbol systems, Hiragana and Katakana, which are referred to collectively as "kana". Hiragana are cursive letters made with flowing strokes and which represent syllables (i.e., combinations of consonants and vowels). Katakana are block letter symbols used to represent the same syllables as hiragana. The hiragana syllabary consists of 48 cursive symbols and 2 diacritics. Some examples of hiragana are:

い, i; き, ki; ひ, hi; び, bi; ぴ, pi

The katakana syllabary duplicates the hiragana symbols and diacritics with symbols that are blockish instead of cursive, but which have generally the same phonetic values:

イ, i; キ, ki; ヒ, hi; ビ, bi; ピ, pi

Katakana are used, in general, to write foreign-sounding loan-words and onomatopoetic terms, and to transcribe foreign personal and place names, while hiragana are used to write native words. This is a simplification, but it captures the essential difference between hiragana and katakana. When words sound unusual or are intended to sound that way, they are written with katakana when they are not felt or intended to sound unusual, they are written with hiragana. Katakana spelling draws attention to the sound shapes of words much more than hiragana does.

Japanese school children learn to write sentences in kana in first grade. After learning kana, students then learn a different symbol system called kanji, and learn to substitute it for some kana. Kanji are morphographs, which are symbols that represent sounds plus meanings or ideas instead of sounds alone, and were borrowed from the Chinese about 1,500 years ago. It is possible for a Kanji to have more than one pronunciation (just as the idea "four-wheeled vehicle for carrying passengers" in English can be pronounced "car" or "automobile"), particularly since Kanji started as Chinese morphographs and then were borrowed by the Japanese. Thus, in most cases they have a Chinese pronunciation and a Japanese pronunciation. The Chinese pronunciation (or "reading") is called an on reading; the Japanese pronunciation is called a kun reading.

In addition to the problem of morphographs that have more than one pronunciation, there are also numerous instances where different symbols, or words, are pronounced the same. These are known as "homophones". For example, the following words, all of which are pronounced identically, have quite different meanings:

| | |
|---|---|
| 恋 | koi, 'love' |
| 鯉 | koi, 'is strong' |
| 故意 | koi, 'intentional(ly)' |

Any typing system which relies upon the phonetically-based kana to identify corresponding kanji encounters serious difficulties because of such homophones, which result in numerous ambiguities. In Japanese written material, the use of different sets of symbols to segment the written information is useful, and makes the sentences easier to understand. This is what English does with the spaces between words, but the Japanese language does not use such spaces. Instead, for example, a written text may include several kanji separated by kana which serve not only as suffixes to the kanji but serve to separate the kanji for ease of understanding. Thus, for example:

| | | | | | |
|---|---|---|---|---|---|
| NHK | の | 番組 | を | 見 | ます |
| alphabet - | kana - | kanji - | kana - | kanji - | kana - |
| N.H.K. | POSS | program | DO | watch | NON-PAST |

'(I) watch program(s) on NHK.'

In the case of inflected words, kanji are often used to represent the roots while the inflectional endings are represented by kana. Kana suffixes that are attached to kanji verb or adjectival roots are called okurigana. For example, if "she fainted" were in Japanese, "faint" would be represented by a kanji, and "ed" by kana.

Kanji are complex graphic symbols and can have various pronunciations. Traditional kanji dictionaries are not organized according to pronunciation, but according to graphic shapes. Some shapes appear repeatedly in many different kanji; these shapes are called bushu in Japanese, or partials or radicals in English. Traditionally, there are 214 partials, and these are used to classify kanji in kanji dictionaries. The Japanese Industrial Standard (JIS) Board recognizes 6,315 kanji, but divides them into two "levels". The first level contains the 2,965 most commonly-used kanji and the second level contains the remainder. 1,945 of the kanji in JIS level 1 belong to the Japanese Government's list of "standard use kanji" which are taught as part of elementary, junior high, and high school curricula. Kanji can be used individually or in combinations.

Examples of kanji are as follows:

| | | |
|---|---|---|
| 魔 | Ma, 'demon' | = 1 kanji |
| 魔術 | mazyutu, 'magic' | = 2 kanji |
| 魔術師 | mazyutusi, 'magician' | = 3 kanji |
| 襲う | osou, 'attack' | = kanji + 1 kana |
| 勇ま | isagiyoi, 'is brave' | = kanji + 1 kana |

In addition to the kana and kanji, a Japanese sentence may also include foreign characters such as the English alphabet, numerals, etc. for which there are no Japanese kana equivalent. In such cases, those foreign characters are merely repeated in the Japanese sentence. A typical prose text, for example, a newspaper article, contains symbols from the four symbol sets in approximately the following proportions:

Hiragana—45%
Katakana—6%
Kanji—45%
English alphabet—4%

Although most symbols in a typical text will be either hiragana or kanji, with katakana, punctuation, and letters of the English alphabet coming up less frequently, nevertheless a typewriter or other data entry system must be able to handle each of these symbol systems. With modern computer techniques, systems have been designed in which the graphics of any one of thousands of Japanese characters can be rapidly displayed or printed. However, the problem is that the desired character has to be identified to the computer system, and the operators of such systems vary in aptitude, ability and experience. The texts that they want to type can also be expected to vary from full, well-composed originals, through skeletal, short-hand abbreviations, to non-written originals that have been dictated or are to be composed on the spot.

If a typewriter system is to be sufficiently flexible to adapt to all of the foregoing variables, then only things that diverse operators and diverse texts share can be incorporated into the system design. The least common denominator of all operators and text materials is represented by a complete novice seeking to type a text which he will compose as he types. The operator will, of course, be Japanese speaking, and he can be expected to know how to spell and what to represent with kana or with kanji, but he will not be familiar with touch-typing techniques. The typist envisions the text as being a string of symbols, some of which are written with kana, some with kanji, some with both kana and kanji in combination, and some with English, and this vision of text must be incorporated into a system design if it is to be sufficiently flexible to accommodate the novice. Of course, the typewriter could be constructed with a single key for each of the kana, kanji, English letters, punctuation, and numerals normally used in writing, but this would require more than 2,000 keys if one key were allotted to each symbol. Although some typewriters and word processors on the market adopt this approach, such systems are bulky, slow and inconvenient to use.

BRIEF DESCRIPTION OF THE PRIOR ART

Numerous attempts have been made to produce a typewriter for Japanese text material which duplicates the flexibility of the alphabetic typewriter and at the same time produces a normal-looking text incorporating symbols from the four symbol sets which comprise the Japanese writing system. However, prior automated typewriting systems for Japanese text material have not been able to deal effectively with the problem of quickly and reliably identifying kanji symbols to be typed. It has been proposed, for example, that a given kanji symbol should be identified by using kana characters to describe it. An example of such a system employing such an identification scheme is shown in U.S. Pat. No. 4,193,119 to Arase et al. Another example is shown in Japanese Pat. No. 55-44612. It has also been proposed to identify kanji characters phonetically by symbols other than kana. Japanese Pat. No. 54-161832 proposed to identify kanji by graphic constituent elements expressed in on or kun pronunciation. Japanese Pat. No. 54-45527 proposed the use of phonetic identifiers expressed in on or kun pronunciation in a different manner. However, a string of phonetic symbols such as hiragana or katakana which is used to identify a given kanji character frequently identifies more than one kanji. Since kana are based on phonetics, and since there are many homophones among the kanji symbols, a kana symbol may frequently identify more than one kanji and may at times identify fifty or more items. Resolving such ambiguities in prior art systems has been very inefficient and has interfered with the development of an effective touch-typing system.

The prior art has made numerous attempts to overcome the difficulties enumerated above and to thereby produce a fast, easy to learn and easy to use Japanese typewritten system. In addition to Arase et al, U.S. Pat. No. 4,193,119, patents such as U.S. Pat. No. 3,778,819 to Bagawan et al as well as publications such as that of H. Horikawa, entitled "Kanji Input Device Using a Kana Keyboard", *Review of the Electrical Communication Laboratories*, Vol. 25, Nos. 3-4, March-April, 1977, pp. 293-307 disclose various techniques for providing a phonetic input to a typing system using a keyboard arrangement. Patents such as Pat. Nos. 4,228,507 to Leban and 4,270,022 to Loh set forth word processors for symbolic languages which are based on a graphic input, the Leban patent using the input as instructions to direct a plotter to draw the desired symbol while Loh provides a keyboard of approximately 250 keys onto which constituent elements of the symbol are mapped. Kirmser et al, U.S. Pat. No. 4,096,934 discloses a word processor which incorporates phonetic and graphic information simultaneously as identifiers for kanji symbols.

Pat. No. 4,124,843 to Bramson et al discloses a keyboard system designed to handle several languages, all of which share a core orthography (the Roman alphabet) with each language having a variable set of special symbols such as umlauts, accents and the like. Function keys permit an operator to assign sets of special symbols to a row of variable keys. Similarly, Pat. No. 3,927,752 to Jones et al discloses a keyboard having means for altering the significance of keys.

Pat. No. 4,141,001 to Suzuki et al, discloses a cathode ray tube screen divided into three areas for use in monitoring information input to the system. Pat. Nos. 1,549,622 and 1,600,494 to Stickney disclose katakana keyboards which are designed for rapid operation and a division of labor equally between the fingers of both hands. These patents also teach the positioning of related kana on the keyboard and the ordering of groups of kana to facilitate rapid learning and easy operation. The layout of the keyboard taught by the Stickney patents was adopted by the Japanese as their version of the standard QWERTY keyboard. Combination kana and alphabet mechanical typewriters also make use of Stickney's layout in a slightly modified form, and the Japan Industrial Standard keyboard for electronic input is this modified form of Stickney.

Japanese Pat. Nos. 43-11528 to Kogio Kijutsium, 54-161832 to Ricoh, 54-45527 to Canon, and 55-44612 to Tokyo Shibaura Denki all disclose keyboard arrangements for providing input to Japanese typewriter systems. The Denki patent proposes the use of kana characters to describe the kanji symbol to be typed, while the Ricoh patent proposes to identify kanji by graphic constituent elements expressed in on or kun pronunciation. The Canon patent proposed phonetic identifiers expressed in on or kun pronunciation in still a different manner, while the Kogio patent proposes to use alphabetic input to obtain hiragana, katakana or kanji outputs.

Such systems in many circumstances are capable of producing normal-looking texts through conventional touch-typing. However, the inputs produced by these systems are often ambiguous and operators are forced to monitor the systems constantly, and to interrupt typing to make selections from lists which sometimes are quite long. Such problems introduce delay into the typing and are a source of fatigue. Systems which rely on graphic representation are especially time consuming and tiring.

The present invention was developed to overcome these and other drawbacks of the prior art by providing a system for touch-typing Japanese text material wherein the operator manually inputs certain text symbols, including hiragana, katakana and alphabetic symbols, and by using both kana and specified delimiter signals to identify kanji-containing words, causes the system to produce specific kanji from its memory, thereby providing an output which is a natural-looking combination of all four symbol sets. The system of the present invention compliments an operator's ability to touch-type by enabling him to have the system add symbols to text for him that he cannot touch-type, yet do so in ways that minimally interfere with his typing.

SUMMARY OF THE INVENTION

It has now been discovered that ambiguities in identifying kanji can be minimized, if not completely avoided, if the characteristics of the art of properly writing Japanese words (Japanese orthography) are considered. Some of these characteristics are that (1) many Japanese words are compound; that is, a word contains a string of two or more kanji and, when so considered, the string is not ambiguous even though the individual kanji making up the string could not be identified by kana without ambiguity. Further, (2) many Japanese words, such as verbs and adjectives, are inflected; that is, the word contains multiple kanji or one or more kanji with a kana suffix. When so considered, the inflected word is not ambiguous, even though the kanji part or parts of the word could not be identified by kana without ambiguity.

Additionally, (3) a given kanji, when individually identified by phonetic kana, is sometimes known to be ambiguous, but is also known to be unambiguous when identified as part of a compound word. In this case, the desired kanji of the compound can be identified by pruning the undesired part or parts of the compound. Finally (4), an operator may know the meaning of a kanji, but cannot read that meaning phonetically although he could describe at least some of the parts of the kanji phonetically. Such a graphic description in kana can identify some kanji unambiguously.

In accordance with the principles of the present invention, methods are provided which permit phonetic symbols to identify Japanese kanji symbols without ambiguity or with reduced ambiguity, and apparatus is provided in which those methods may be practiced through the use of a keyboard which permits "touch-typing" of Japanese text. It is, therefore, an object of the present invention to provide a method and apparatus in which Japanese text material containing kanji symbols may be treated either as a compound or as a part of such a compound, and wherein such symbols may be identified phonetically.

Another object of this invention is to provide a method and apparatus in which kanji symbols that would otherwise be expressed ambiguously as individual symbols may be phonetically identified in two steps by first identifying a compound in which the desired kanji appears without ambiguity, and then pruning the compound of unwanted symbols.

Still another object of the invention is to provide a method and apparatus in which kanji characters not pronounceable by the operator may be identified through phonetic description of the parts of the character.

Briefly, the system of the present invention has four basic components. A microprocessor, a keyboard used to communicate with the microprocessor, a cathode ray tube display screen which displays both the keyboard output and the output from the microprocessor, and a printer which permits the system to provide a permanent record of the text material.

In accordance with the invention, a keyboard suitable for touch-typing is capable of producing several thousand symbols in a written text, through the use of a small subset of those symbols to provide access to the remainder. Hiragana symbols fulfull the subset function in Japanese language typewriters, for they fit easily onto a standard QWERTY keyboard, along with katakana, the English alphabet, Arabic numerals, and punctuation. Further, hiragana can be used to access what will not fit on the keyboard; mainly kanji symbols. The kanji symbols are stored in an internal dictionary within the microprocessor memory. The system is adapted to retrieve the stored kanji symbols and insert them into a text on instructions from the microprocessor, by responding to hiragana input by the operator, comparing that input to the contents of the dictionary, and inserting the kanji identified by the hiragana into output text. This operation is referred to as a "kana-kanji conversion". The operator uses the keyboard for two things:

(1) Inserting hiragana, katakana, the English alphabet, numerals, and punctuation into a text directly; and (2) Instructing the system to insert specified kanji into the text.

To be effective, the instructions for kana-kanji conversion must be logical and economical from both the operator's and the system's points of view. It is in this conversion that the present invention finds its primary distinctions over the prior art, for the invention is designed to anticipate what a Japanese speaking operator knows about how his language works. Thus, the operator is relied upon to spell Japanese sentences to the system in kana and to use special function keys according to his requirements for how the written sentence should look, including instructions to the computer concerning which sections of kana should be rewritten in kanji.

When an operator types in hiragana, katakana, numerals, punctuation marks, or the English alphabet, the key strokes are interpreted unambiguously, and the corresponding symbols are displayed on the cathode ray tube. To accomplish this, a standard QWERTY keyboard is used, and function keys are added to it which permit the keyboard to be changed from one that produces hiragana or katakana. Kana typewriters have been in use in Japan for more than 75 years and a standard kana keyboard layout has been devised and put to use by typewriter manufacturers. Since the number of hiragana or katakana is small, a QWERTY keyboard can accommodate them with no trouble.

The major features of the present invention lie in the way that an operator can get the system automatically to substitute the appropriate kanji for kana in the material being typed. An operator has two strategies available to him in the present system for this purpose. The primary approach is a phonetic one; the operator uses the kana keyboard and three delimiter keys to spell words to the computer according to how they are pronounced. The secondary strategy is designed to handle words an operator can't pronounce. In this latter case, the operator describes what the unpronounceable word looks like in terms of lines and shapes, thereby enabling the microprocessor to select the desired kanji symbol.

More particularly, an operator may treat a text to be typed simply as a string of symbols, some of which happen to be kana and others kanji. For purposes of the following discussion, kana will be considered to be hiragana symbols; katakana, English alphabet, numerals and punctuation will be omitted for the sake of simplification.

In a text to be typed, typically there will be stretches of kana alternating with stretches of kanji:

| | | | |
|---|---|---|---|
| kanji | kana | kanji | kana |
| bukkadaka | no | keekoo | ga aru |

'There is a tendency towards high prices.'

The operator of the system selects a text, identifies the alternating stretches, and brackets them. An operator familiar with the Japanese language can accomplish this without too much difficulty. The keyboard is equipped with "delimiter" keys which produce segmentation, or "conversion", signals for the purpose of bracketing these stretches in the signals supplied to the microprocessor. Thus, the input to the system will be strings of kana punctuated by conversion delimiters (indicated by slashes in the following examples), the delimiters distinguishing stretches of kana from stretches of kanji in the text they want to produce. The microprocessor treats the delimiters in pairs, with the kana between them thereby being bracketed for kana-kanji conversion.

The kanji dictionary contained in the microprocessor contains the kana spellings for corresponding individual kanji symbols. The system compares the input from the operator to the list of kana spellings and, when there is a match, provides an output of the corresponding kanji symbol. Accordingly, from an input of kana phonetic spellings such as:

| | | | |
|---|---|---|---|
| / いま | / から | / はじ- | / まる |
| i ma | ka ra | ha zi | ma ru |

The system produces the following output:

| | | |
|---|---|---|
| 今 | から | 始まる |
| ima | kara | hazi ma ru |

'(We) will start now.'

However, the conversion illustrated above is not a one-step process, because both "ima" and "hazi" are ambiguous in that they are homophones; i.e., two or more kanji symbols have those same sounds, but have entirely different meanings, and the operator must then select which one he wants.

Since homophones of this sort are the rule rather than the exception in Japanese, the best the system can do when a text is treated simply as a string of symbols is to produce a list of the homophones on the CRT display, to enable the operator to make a choice. However, the lists of homophones produced in this manner (i.e., by segmenting the input on the basis of symbols) are often very long and are usually heterogeneous. Lengthy lists of this sort are stumbling blocks for operators, who must stop their work to wade through sets of miscellaneous, unexpected alternatives. Furthermore, many of these alternatives are confusing because they normally never appear in isolation or, if they do appear, do so with different pronunciations or meanings. Thus, to be effective, an input method must minimize the occurrences of homophone lists and make lists simple and short when they cannot be avoided.

A better solution to the problem of kana-kanji conversion is to treat a sentence as a string of words, rather than simply as a string of symbols. Thus, the operator identifies certain kinds of words, and brackets them. Some words in texts contain kanji, while others do not, and operators can use delimiters to distinguish words with kanji in them from other kinds of words in the text. Again, the delimiters are treated in pairs, with the kana between them being candidates for kana-kanji conversion. In this case, the microprocessor dictionary contains the kana spellings for words (which may be a combination of kanji and kana or may be two or more kanji) instead of for single kanji symbols. Thus, from an input like this:

| | | | | | |
|---|---|---|---|---|---|
| /いま/ | から | / しき | /を/ | おこなう/ | (Ambiguities |
| *i ma | ka ra | *si ki | o | o ko na u | are starred.) |

is produced the following output

| | | | | | |
|---|---|---|---|---|---|
| {今 居間} | から | {式 四季} | を | 行う | (Ambiguities |
| ima | ka ra | siki | o | okonau | are bracketed.) |

Additionally, morphological (or meaning) information about words can also be incorporated into the input signal produced by the operator, for operators have little difficulty in picturing words with kanji in them as being simple or complex, inflected or uninflected. Simple words have one kanji in them; complex words have more than one; and inflected words (verbs and adjectives) can be identified by kana suffixes. The keyboard includes additional delimiter keys that permit the operator to represent this information to the microprocessor.

Thus, for example, an "add" delimiter (represented by a "+" in the following examples) may be used by the operator to distinguish simple uninflected words from complex words, and may be used to distinguish complex uninflected words from each other:

| | |
|---|---|
| 石+段 | isidan, 'stone steps' |
| 医+師+団 | isidan, 'team of doctors' |

A terminal delimiter (represented by "—" in the following examples) may be used by an operator to distinguish inflected words from uninflected words:

| | |
|---|---|
| 恋 | koi, 'love' |
| 故+意 | koi, 'intentional(ly)' |
| 濃-い | koi, 'is strong' |

Morphological information is also included in the system dictionary so that from information like this:

| | | | | | |
|---|---|---|---|---|---|
| /いま/ | から | /し+き | /を/ | おこなーう/ | (Ambiguities |
| i ma | ka ra | *si ki | o | o ko na u | are starred.) |

the system produces output like this:

| | | | | | |
|---|---|---|---|---|---|
| 今 | から | {指揮 四季} | を | 行う | (Ambiguities |
| ima | ka ra | siki | o | okonau | are bracketed.) |

By segmenting the input to the microprocessor on the basis of words and including morphological information in the input, ambiguity and the resultant need to list homophones in the output, is minimized. Lists, when they do occur, are short and homogeneous. The input becomes more efficient, yet is still constituent and natural-seeming to the operator. This procedure reaches its limits, however, when morphologically identical homophones such as the following are encountered:

| | | | |
|---|---|---|---|
| 四季 | siki, 'seasons' | 指揮 | siki, 'direction' |
| 死期 | siki, 'hour of death' | | |

In this situation, the system displays such homophones as lists of numbered choices and the operator selects the homophone desired by means of numbers located on the keyboard home row. Short homogeneous lists can be memorized with practice by an operator, thus making possible the selection of a desired kanji without referring to the displayed homophone list, and thereby making touch-typing possible. A novice typist can hunt-and-peck and refer to homophone lists as much as he needs to, while an expert, through familiarity with the keyboard layout and the contents of lists, can touch-type with fluidity, so that the system is extremely flexible.

It is not unusual for written Japanese text to contain words an operator does not know and, therefore, cannot spell in kana. Personal and place names, for example, may be written in kanji or combinations of kanji that is unfamiliar to an operator. Further, written text material which is to be typed can also contain words that are unfamiliar to the system itself. Kanji neologisms, acronyms, and technical vocabulary are likely to be missing from the system dictionary, and therefore would be inaccessible even to operators who can recognize and input them phonetically for conversion. Neither the operator nor the system can be expected to know everything; both, however, must be given the means to be adaptable.

Such adaptability is provided in accordance with the present invention through an input technique which may be referred to as "word analysis". It is common for kanji to have more than one kana spelling, or reading. An operator unfamiliar with or unsure of any one reading is likely to know others. Word analysis enables operators to tap this knowledge in order to input words with which the system is unfamiliar. Thus, confronted with a vocabulary item having several kanji, and which is unfamiliar to the system, the operator can instead input known kanji words which incorporate portions of the desired vocabulary items but with different readings. The keyboard of the present invention is equipped with function keys to permit pruning of the unwanted portions of the substitute kanji to thereby produce the desired vocabulary item. An example of this procedure is illustrated in the following sequence, in which the unwanted portions of the selected kanji are underlined:

(1) wants 行 手
(2) selects substitute 行 攻
(3) prunes 攻 and is left with 行
(4) selects substitute 改 手
(5) prunes 攻 and is left with 手
(6) the product is 行 手

The adaptability of the present system is further enhanced by another input technique referred to as "shape analysis". Kanji that an operator cannot pronounce at all cannot be entered into the system phonetically. Such kanji can, however, be input graphically, provided the operator has some means of encoding kanji shapes with the kana keyboard. Shape analysis makes non-phonetic input possible with a phonetic system.

Kanji are collections of smaller parts (or partials) that are assembled in particular sequences. The partials which are present in a given kanji, and the order in which they appear, are what distinguish different kanji from each other, as illustrated in the following example:

口 (kuti, 'mouth') 昭 (syoo, 'bright')
召 (me(su), 'summon') 照 (te(ru), 'shine')

The various partials can be given kana names, since the number of partials that appear regularly in kanji is comparatively small.

By providing the keyboard with a shift key that will produce signals to enable the microprocessor to differentiate phonetic from non-phonetic input, operators may use the same keyboard to input phonetic descriptions of words and to input graphic descriptions of individual kanji. Signals from the shift key are treated in pairs and the kana between them are treated as shape identifiers for kanji. The system dictionary contains the shapes which correspond to the kana identifiers in addition to the kanji which correspond to phonetic identifiers already described.

To provide an input using shape analysis, the operator identifies a desired kanji by shape, by listing the kana names of the partials found in the kanji. The operator starts where he would if he intended to draw the kanji by hand, and adds partials to the list in the order he would draw them using pen and paper. Examples of this process are as follows:

| | | | | |
|---|---|---|---|---|
| 副 | → | 一 口 田 刂 | → | iti, ro, ta, ri |
| 尋 | → | 彐 工 口 寸 | → | yo, e, ro, sun |
| 孫 | → | 子 ノ 系 | → | ko, no, ito |

Partials, or radicals, have been used traditionally to catalog kanji in dictionaries, and are called bushu in Japanese. Historically, there are 214 partials with a complexity ranging from a single brush (or pen) stroke to those of 16 or more strokes. These historic partials have been given names that are from one to eight kana long, and as a result, any kanji may be described by listing the names of the partials. The order in which the partials are listed is crucial to the unique identification of a kanji. The fact that the order in which individual brush strokes are assembled to compose a kanji is fixed, as well as the fact that stroke order is inculcated almost indelibly in the process of gradeschool education, plays an important part in this process.

The fact that kanji range in complexity from ideographs of one or two brush strokes to 28 or more brush strokes bears significantly on the number of partials that will have to be incorporated in the shape identifier system, for if care is not taken, identifier names for kanji will be over-long, even on the average. However, as kanji get more complicated, it is often the case that they are analyzable into smaller and smaller numbers of more and more complex partials so that a trade-off results and complicated kanji can be broken down into approximately the same number of partials as simpler kanji.

When confronted with a kanji for input in terms of partials, the operator "walks through" the kanji, identifying all parts of that character by typing the names of the partials encountered in terms of their kana names. Occasionally an operator will encounter a portion of a kanji that cannot be interpreted in terms of any of the partials known to the system. Since most kanji contain an average of three or more partials, however, the known portions may be sufficient to enable the system to locate the desired character. Accordingly, a generic name, which may be represented on the keyboard by "?", is provided for use by the operator when he cannot assign a name to a partial. This allows the system to search for kanji which include the known partials.

In addition, since different operators see different partials in many kanji, different avenues must be provided to arrive at the same output. Accordingly, when more than one order for assembling partials is conceivable, all orders are included in the system's dictionary. Thus, for example, a kanji can be broken down into its partials as follows:

| | |
|---|---|
| 測 | ・氵 目 刂<br>・氵 ? 刂 |

In addition, if more than one set of partials can be found in a kanji, then all sets are included in the system's dictionary. For example:

| | |
|---|---|
| 充 | ・ 古 儿<br>・ 十 兄<br>・ 十 儿 |

The system is then capable of responding to inputs which are ambiguous because some of the partials are unknown, or because more than one set of partials can be found.

In summary, then, the present invention provides a Japanese typing system having a hiragana keyboard (which also includes katakana, English alphabet, arabic numerals, and punctuation) and which can be used to access kanji symbols stored in a system-internal dictionary. The system retrieves kanji and inserts them into a text automatically on instructions from the operator. Kanji are identified phonetically by kana from the keyboard either by spelling out the desired kanji, or, if ambiguities occur, or if the reader does not know how to spell the kanji phonetically, through word analysis or shape analysis. The system permits rapid touch-typing of Japanese language and is capable of utilizing the four syllabaries from which the Japanese written language is constructed. The system is flexible in that is usable not only by novices, but by experts, and can be learned quickly through practice. To enable the system to function properly, the keyboard includes delimiter keys which are operable to group selected inputs for handling by the microprocessor and for subsequent display of desired symbols.

BRIEF DESCRIPTION OF THE DRAWINGS

The foregoing objects, features and advantages of the present invention will become apparent to those of skill in the art from a consideration of the following specification, taken in conjunction with the accompanying drawings, in which:

FIG. 1 is a block diagram of the system for typing Japanese text;

FIG. 2 is an illustration of the system keyboard;

FIG. 3 is an illustration of the system keyboard highlighting the plurality of second keys thereof which are operable to produce delimiting coding signals;

FIGS. 4*a* and 4*b* illustrate the sequence of operations performed for phonetic input of text;

FIG. 4*c* illustrates the sequence of operations for manual selection of symbols to resolve ambiguities;

FIG. 4*d* illustrates the sequence of operations for phonetically producing second symbol-containing words in addition to those in the first and second groups of symbols that are novel to either the system or operator; and FIG. 4*e* illustrates the sequence of operations for graphically producing second symbol-containing words in addition to those in the first and second groups of symbols that are novel to either the system or operator; and FIG. 5 illustrates the assemblage of FIGS. 4*a*–4*e*.

DESCRIPTION OF PREFERRED EMBODIMENTS

Figure 4A:
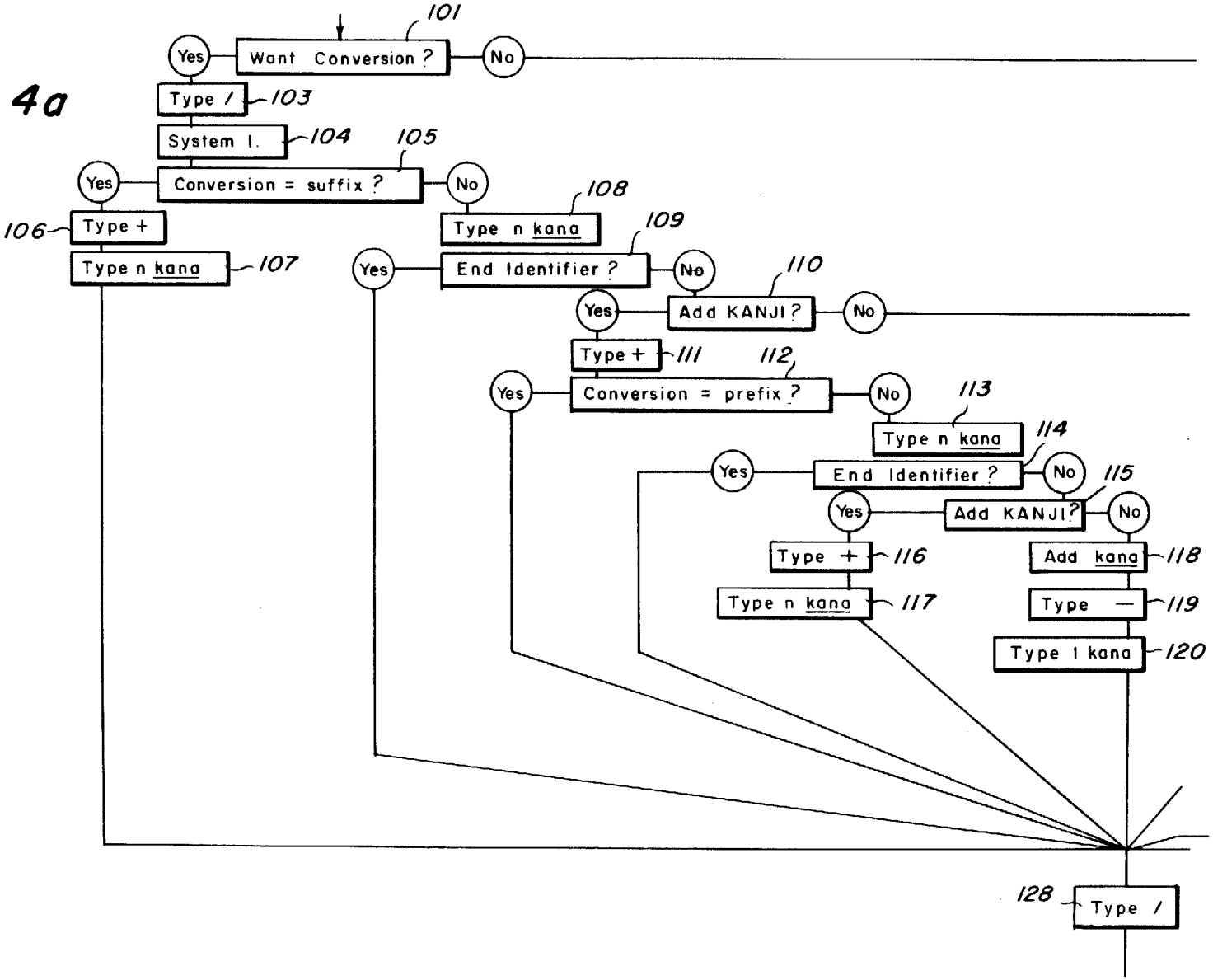
FIGS. 4*a*–4*e* taken together illustrate a flow chart of the sequence of operations performed by the Japanese typing system, and more specifically

Turning now to a more detailed consideration of the present invention there is illustrated in FIG. 1 in simplified form the system of the present invention for typing Japanese text material. The system includes a keyboard 2, a microprocessor 4 connected to the keyboard 2 and adapted to receive input signals corresponding to the operation of the various keys on the keyboard 2, a memory 6 connected to the microprocessor 4, a cathode ray tube (CRT) display unit 8 connected to the microprocessor 4 and to the memory 6, and a printer 10 such as a line printer connected to the microprocessor 4 and to the memory 6. In one embodiment, the memory 6 is incorporated into the microprocessor 4 and preferably the microprocessor 4 and memory 6 are combined in a processing unit 12.

As illustrated in FIG. 2, the keyboard 2 includes a plurality of keys which are adapted to produce corresponding input signals to the microprocessor 4 when operated. The keyboard 2 includes a first set of symbol keys 14 which represent hiragana, katakana, and alphabetical symbols to enable the system operator to touch-type kana by selectively operating the keys 14. A second set of keys, including function keys 16, 18 and 20, are provided to enable the operator to select the kana or alphabetic symbols which are to be represented by the first set of keys 14. Thus, the operation of function key 16 causes the first set of key 14 to be mapped in accordance with hiragana, function key 18 causes the keys 14 to be mapped in accordance with katakana, and function key 20 causes keys 14 to represent alphabetic symbols. Accordingly, to type kana or alphabetic symbols, the operator simply selects the corresponding function key 16, 18 or 20 and the touch-types the desired kana or alphabetic symbol represented on keys 14.

The keyboard 2 responds to inputs from keys 14 to send corresponding input signals to the microprocessor 4 which, in turn, calls up the selected symbols from memory 6 and displays them directly on the CRT display unit 8 and/or causes them to be printed on printer 10. Because hiragana is more commonly used in the written language, the keyboard 2 may be referred to as a hiragana keyboard, with its mapping being changed to katakana or to the letters of the English alphabet by the function keys 16, 18, and 20 as needed. As illustrated in FIG. 2, the hiragana keyboard 2 incorporates arabic numerals on the second row, although the numerals are shifted to the fourth, or top, row when the keyboard 2 is shifted to alphabetic mapping. Punctuation symbols are always available and are located on the same keys 14 no matter which type of mapping is being used.

To enable the system to produce a kana-kanji conversion in typed text, the second set of keys on the keyboard 2 includes a plurality of delimiting keys 22, 24 and 26, illustrated in FIG. 3. This figure is a duplicate of FIG. 2, but eliminates the kana symbols on keys 14 in order to highlight the delimiting keys 22, 24, 26 and others to be discussed. Kana-kanji conversion is accomplished by selectively operating the conversion delimiting keys 22 and the symbol keys 14. This enables the operator to access the microprocessor memory 6 (FIG. 1) to call up selected stored kanji by means of identifier signals supplied to the microprocessor 4 in the form of a string of kana and interposed delimiter signals.

To type a document which may include a mixture of hiragana, katakana, kanji or English alphabet, the operator selects one of the function keys 16, 18 or 20 to select the input syllabary, and then activates selected symbol keys 14 to produce corresponding input signals $S_f$(FIG. 1) which are fed to the microprocessor 4. The operator may also selectively operate the delimiter keys 22, 24 and 26 to produce corresponding delimiting coding signals $S_{dc}$ (FIG. 1) to define groupings of the kana input signals. These delimiting signals are also delivered to the microprocessor 4 for processing.

The microprocessor 4 responds to the input signals $S_f$ to produce display signals $S_1$ corresponding directly to the kana associated with each of the selectively operated symbol keys 14 when the strings of kana input signals are not segmented by delimiting signals. These signals $S_1$ produce the corresponding kana and alphanumeric displays directly in the text portion 8*a* of the CRT display 8. The microprocessor 4 is further responsive to the combination of kana and delimiting signals to produce addressing output signals $S_a$ which are delivered to the memory 6. Within the memory 6, at specified addresses, are stored the data required to produce various kanji symbols which are to be typed. The memory 6 includes this information in the form of individual kanji or lists of kanji grouped in accordance with predetermined identifier codes which correspond to the phonetic spelling of the kanji or the partials which make up the shape thereof. Since kanji may have more than one kana spelling and since their shapes may be described in a variety of ways, lists are provided for each spelling and each shape sequence, all of which are accessible by the identifier address signals $S_a$.

The memory 6 responds to the addressing signals $S_a$ to produce output signals $S_2$ which represent a corresponding symbol, combination of symbols, or list of symbols, which signals are delivered to the CRT display unit 8. If the signal $S_2$ represents a kanji word unambiguously, it is sent to the text portion 8*a* of the CRT display for direct inclusion in the text material. If, on the other hand, the signals $S_2$ represent a list of kanji symbols, so that the conversion is ambiguous, then the list is displayed in a second, or assembly, portion 8*b* of the CRT display, apart from the text location, for subsequent disambiguation in the manner to be described, and transfer of the desired kanji to the text portion 8*a* of the CRT display. The printer 10 can be actuated by the operator to print out the sequence of symbols appearing on the text display.

When the operator types a document, for example a letter, he must visualize the text as a sequence of words, some of which are represented by kana, some of which include English alphabet, and some of which contain kanji. Since the keyboard 2 is mapped in kana, the desired kanji symbols must be called up from memory 6 by means of kana input. The kana which corresponds to kanji is differentiated from kana or English words by means of a conversion delimiter key 22 which sends delimiting coding sighals to the microprocessor 4. As illustrated in FIG. 3, the conversion delimiter key 22 may be the spacer bar on a standard keyboard and may be operable to produce a conversion delimiting signal "/". This delimiter, like other delimiters, is simply an instruction for the system, and does nor appear in the output text from the typewriter.

The operator inputs strings of kana with the set of symbol keys 14 and segments the strings into groups of kana by means of pairs of delimiting signals/produced by the key 22 whenever a kana-kanji conversion is required. The microprocessor 4 responds to a pair of conversion delimiting signals from key 22, using the group of kana input signals which occur between the pair of delimiting signals, to generate addressing signals for kana-kanji conversion. The memory 6 contains the kanji symbols which are identified by delimited kana spellings and responds to the addressing signals produced by the kana spellings to cause a display of the addressed kanji.

Because the kana spellings used to produce the kana-kanji conversion are phonetic, these spellings may call up more than one kanji, since many kanji are pronounced the same way. Thus, for example, the typed kana input for the phonetic sound "kaki" can, in a kana-kanji conversion, produce the kanji ideograph meaning "persimmon", but can also produce the kanji ideograph meaning "fence", since these kanji are homophones These are single-symbol homophones; additional kanji pronounced the same way also exist, but those are compounds which can be differentiated from the single-kanji homophones. When the only thing an operator types between a pair of interrupt delimiters is the kana grouping pronounced "kaki", the system is faced with an ambiguity, (i.e., the possibility of more than one output from a single input), and additional information is required from the operator in order to produce only the desired kanji in the final text material.

MANUAL RESOLUTION OF AMBIGUITIES

In cases where the memory 6 responds to an addressing signal produced by the kana identifier string to produce a list of kanji, either single or compound, such a list is displayed on the assembly portion 8*b* of the CRT display unit 8 as numbered choices. This assembly portion 8*b* of the CRT screen is separate from the text material to enable the operator to identify and select the desired kanji. Selection is accomplished by operating one or more of a third set of keys which comprise a plurality of selector keys 28 on the keyboard 2 of FIG. 3. These selector keys 28 are numbered 1 through 0, and their operation produces an input to the microprocessor 4 which, in turn, transfers the correspondingly numbered kanji to the text portion 8*a* of the CRT display. Provided that the displayed lists or kanji are kept short and homogeneous, they can be memorized by an operator so that the selection of desired kanji from a list can often be made without reference to that list by an experienced typist. On the other hand, a beginning typist who has not yet had an opportunity to memorize the list can consult the CRT display to make his selection, thereby making the typewriter system of the present invention accessible to both skilled and unskilled typists. The system thus allows the skilled typist to use touch-typing techniques in the preparation of Japanese language text material which intermixes kana, kanji and English alphabet symbols after he gains familiarity with the keyboard layout and the contents of the homophone lists.

AUTOMATIC RESOLUTION OF AMBIGUITIES

(a) Add Function

Although the manual resolution of ambiguities discussed above greatly speeds the typing of Japanese text material, such typing is further facilitated in accordance with the present invention through the use of functions which provide automatic resolution of many ambiguities. Thus, for example, if the operator knows that the kanji he seeks in a kana-kanji conversion is a compound; i.e., is a word comprising at least two kanji, he punctuates the group of input kana, which has been segmented by the conversion delimiters "/" with the "add" delimiter +, from key 24 in the second set of keys 22, 24, 26. The + signals are inserted between sequential segments of the input kana group which correspond to the symbols which make up the kanji compound. Thus, the add signals define within the kana groups those identifier signals which are to be converted to a kanji compound.

For example, the kana input [illegible] represents the single-kanji [illegible], which means "persimmon". The input [illegible] represents the two-kanji homophone of [illegible] written [illegible], which means "firearm". The add signal "+" indicates to the microprocessor and the memory that more than one kanji are desired for output corresponding to kana input [illegible]. This enables the system to reduce ambiguities and helps to produce the proper text.

(b) Terminal Delimiter Function

A second method for reducing the number of ambiguities in the lists of kanji called up by the system is provided by a third delimiter function produced by the operation of third delimiter key 26. This delimiter signal is here represented as "−" and is used to further segment a group of kana which are being used to provide a kana-kanji conversion. The terminal signal "−" defines a kanji symbol which is combined with a kana suffix; therefore, the first kana following the terminal function "−" is used by the microprocessor 4 to distinguish among possible kanji homophones. Thus, the kana inputs within a group which precede the terminal function "—" are used by the microprocessor 4 to call up a list of kanji from the memory 6, while the kana following the terminal function selects from the list any kanji which may be combined with the given suffix, thereby limiting the number of kanji in the list to be displayed on the CRT display unit 8. This automatically reduces the ambiguities in the lists and simplifies the work of the operator.

An example of the use of the terminal function is as follows: the kana input represents the single-kanji word , while kana and ⊕ input represents the two-kanji word . Both words are homophones pronounced "kaki". The word is also pronounced "kaki". It contains the kanji and the kana . This homophone is differentiated from and by the terminal signal —, which enables the system to produce the desired output .

Typing Unfamiliar Words

The system of the present invention is also operable to produce kanji-containing words that are novel either to the system or to the operator. It is not unusual for written Japanese text material to contain words an operator does not know, cannot pronounce, and therefore cannot spell in kana. Personal and place names, for example, may be written in kanji or in kanji combinations with which an operator is unfamiliar. Written text material for input can also contain words which are likely to be missing from the system memory 6, such as kanji neologisms, acronyms, and technical vocabulary and which are, therefore, inaccessible even to operators who can recognize and input them phonetically for conversion. The present system is capable of adapting to such situations in two ways; through word analysis and through shape analysis.

(a) Word Analysis

One input technique that expands the capabilities of the system of the present invention is word analysis. It is common for kanji to have more than one kana spelling, or "reading", and an operator unfamiliar with or unsure of any one reading is likely to know others. The word analysis technique of the present invention enables operators to tap this knowledge in order to type words not contained in the system memory 6. Thus, for example, if the operator is confronted with a rare vocabulary item such as , he can instead type in the kana strings which correspond to and , both of which are words with which the system is familiar and in which the kanji and each appear with different readings. In similar manner, if the operator is faced with an acronym like , the operator can input , the full form of which will appear on the text display portion 8*a* of the CRT display.

Of course, the displayed kanji are not those which are required, so to convert the displayed items to the desired item, the system is provided with a pair of word analysis delete function keys 30 and 32 (see FIG. 3) and a conventional cursor which allows the operator to select and then delete the unwanted portion of the displayed words. For the first example given above, the operator would use the following input sequence (the unwanted portions of the displayed kanji being underlined in the example):

(1) wants
(2) selects substitute
(3) deletes and is left with
(4) selects substitute
(5) deletes and is left with
(6) the product is A similar sequence of operation could be used with the acronym identified above wherein portions of the full form kanji display are deleted to leave the desired word in the text.

Word analysis may also be used to speed up the selection of a particular kanji when it is known to the operator that there is a long list of homophones and the operator wishes to shorten the list by removing some of the ambiguities. Thus, for example, an operator who wanted to output the kanji which means "a city ward or borough" would use the kana keyboard to input "ku", which is the phonetic spelling of that word. However, there are more than 20 additional commonly used kanji which are phonetically spelled "ku". These would normally be listed by the microprocessor memory 6 on the assembly portion 8*b* of the CRT display unit 8, and the operator would be asked to select the particular "ku" he wanted from the list. The operator would be confronted with lists of this size every time he had to output a single kanji having numerous homophones.

However, the kanji for "a city ward or borough" also happens to be the first half of the compound word pronounced "kuiki" (a district) and is the second half of the compound word which is pronounced "tiku" (a zone). Since longer words like kuiki and tiku are much less ambiguous than single kanji pronunciations such as "ku", by inputting "kuiki", for example, the operator is not faced with more than 20 possible alternatives for output, but with only one. In the case of "tiku", he is faced with two possibilities.

The word analysis delete function keys 30 and 32 enable the operator to reduce the time required to obtain the desired kanji and thus reduce ambiguities, by selecting the longer kanji word and then deleting the undesired portion. A further example of word analysis is as follows:

(1) An operator wants to output the kanji .
(2) He uses the kana to input 'kuiki'; 'kuiki' is umambiguous, so the two kanji appear in the line of text on the CRT display.
(3) He uses his right index finger to depress word analysis delete function key 30. Use of the first finger is the equivalent of saying, 'The 'ku' (first half) of 'kuiki'.'
(4) When key 30 is depressed, the system erases the second kanji in compound , leaving first kanji standing alone and the screen cursor positioned to its right.
(5) Instead of (2), the operator inputs 'tiku' and gets the compound in the line of text on the CRT display.
(6) He uses his right middle finger to depress word analysis delete function key 32. Use of the second finger is the equivalent of saying, 'The 'ku' (second half) of 'tiku'.'
(7) When key 32 is depressed, the system erases the first kanji in compound , leaving second kanji standing alone and the screen cursor positioned to its right.

The word analysis delete function keys 30 and 32 incorporate what are essentially text editing functions, with key 30 providing an input signal which indicates that the character to the left of the cursor is to be erased, and key 32 providing an input signal which indicates a back space in the text, erasure of the character to the left of the cursor, and a forward space. The keys 30 and 32 are so located on the keyboard 2 of FIG. 3 as to facilitate this function and thus speed the operator's work.

(b) Shape Analysis

A situation where an operator is faced with having to input a word or string of words he can't pronounce is not inconceivable in Japanese. For example, the names of people, places and corporations are often unpronounceable if represented with combinations of kanji not familiar to the operator. Where this is the case, the identifying symbols for the kanji cannot be input phonetically either using the kana keyboard or using word analysis, because the operator does not know any readings at all for the kanji. The system of the present invention provides, for this situation, a function referred to as shape analysis which is selectable by a shape key 36 on the keyboard and which enables the operator to input a graphic identifier string corresponding to the desired kanji. When an operator uses the shape key 36, the keyboard layout remains the same as in hiragana, but the microprocessor 4 responds to strings of kana which represent the names of the shapes found when an operator describes what a kanji symbol looks like, instead of responding to phonetic spellings of the way the kanji are pronounced. Since kanji are formed from separate strokes which are assembled in particular orders, individual kanji may be identified graphically by inputting the names of strokes or groups of strokes present in them.

Operation of the shape key 36 instructs the microprocessor 4 to differentiate non-phonetic shape identifier input from phonetic input and, since the memory 6 contains kanji identified by shape as well as by phonetics, the memory 6 is capable of producing a kanji symbol in response to a kana input string which defines its shape. Thus, any kana string delineated by conversion (/) delimiters and preceded by a signal from the shape key 36 will cause the memory 6 to produce kanji based on a shape description.

An operator of the system of the present invention may identify kanji by shape by first depressing the shape key 36 and the conversion delimiter key 22, and then by typing the kana names of strokes or stroke groups in the desired kanji in the order that the strokes would be drawn if the desired symbol were to be drawn by hand. Where a stroke or stroke group does not have a kana name, or where the operator does not know the name, a generic signal, represented, for example, by the symbol "?" on key 38 (FIG. 2), is typed into the kana string. The microprocessor 4 responds to a kana string having a "?" included in it by producing a list of kanji having all of the remaining partials in the sequences given. Since different operators may see different configurations or sequences of partials in a given kanji symbol, the memory 6 must also incorporate lists of kanji with these different sequences as identifiers so that the system is capable of responding to a variety of operators.

It will be appreciated by those skilled in the art that the arrangement of the keys on the keyboard of FIGS. 2 and 3 are shown for illustration only, and need not be limited to the particular configuration. What is important is that the kana keys and the function keys be arranged on a single keyboard, such as a modified JIS keyboard, in order to allow touch-typing. However, the layout of the numbers 1 to zero in the second row, and the triangle formed by the function keys 22, 24 and 26 are the preferred layout for keys involved in phonetic identifier output. This layout distributes the workload of delimiters most efficiently. The layout of the word analysis delete function keys 30 and 32 is also preferred, since it makes use of the right, first and second fingers to designate the first or second syllables of compounds for inclusion in text. The location of the shape input key 36, which is shared with the alphabetical function key 20 in its shifted position, is a matter of convenience and may be moved to a different location as desired. The numbers 1 to 0 are used for inserting numerals into text as well as for making selections from lists; this avoids confusing the operators. However, in an alphabetic mapping of the keyboard, the numbers move to the top row, which is their standard position on alphabetic keyboards, to make room for capital letters in the shifted home row positions. Numbers, delimiters, word analysis delete function keys, shape input and other keys are located in positions designed to facilitate touch-typing so that operators do not have to take their eyes off the text they are inputting or relocate their hands from the home row.

Method of Operation

The flow diagram of FIGS. 4*a* through 4*e* illustrates in detail the steps operators go through in typing Japanese text material using the various symbols in common use in the Japanese language. Kana and English alphabet symbols can be typed directly, while kanji are typed through the use of symbols stored in memory 6 and accessed by phonetic descriptions, or by graphic analysis. To produce kanji, the system responds to operator input by looking up the identifiers in its internal dictionary and producing the kanji symbol on a display. Sometimes a phonetic identifier will call up only one item, and in this case the system of the present invention inserts this item directly into the text the operator is creating. More often, however, a phonetic identifier selects more than one item. In such a case the system produces a list of numbered choices from which operators select the item they want for insertion into the text. The role of the delimiter functions is to minimize the need for operators to make selections from lists and, when lists do occur, to make them short and homogeneous.

Occasionally, operators may confront the system with identifiers it doesn't contain in its dictionary. Two types of backup input are included in the system for use on such occasions. Both types of input can be carried out using the kana keyboard. The first type is referred to as word analysis where operators treat kanji individually, input a compound phonetic identifier for that kanji that the system does know, and use one or two word analysis delete function keys 30, 32 to prune the unwanted portion of the compound, leaving the desired kanji behind in the text. The second type is called graphic identifier input, wherein operators analyze individual kanji into parts that can be named using the kana keyboard, input a list of names, and obtain an output of the desired kanji without having to rely on phonetics. Thus, with the system of the present invention, ambiguities which occur when kana phonetic identifiers are input for conversion into kanji are minimized; lists of ambiguities which do occur are kept short and homogeneous, and any kanji-containing words can be produced without having to store every word or potential word in the memory.

The system memory 6 can be limited to a core vocabulary of more common words, names and abbreviations. The smaller this core, the less likely the overlap (homophony) along its members. At the same time, items in this core can be used to access items that are not in the core through word analysis, thereby extending the system's reach to unknowns for which operators can think up alternate phonetic identifiers. Furthermore, graphic shape analysis makes input possible even when phonetic identifiers are unknown to an operator, thus further extending the system's reach. Word analysis and graphic shape analysis work to keep the system's memory 6, which is its dictionary of kanji listed in accordance with both phonetic and shape identifiers, uncluttered. Old fashioned kanji, rarely used kanji, or even common kanji with occasionally unusual pronounciations need not appear constantly in lists of homophones. At the same time, they can be accessed when necessary from the kana keyboard 2 that the operators are already using for the phonetic input. The three delimiting functions work to make the system memory 6 easier to access and enable operators to acquire mastery over it quickly. This makes typing smooth and makes true touch-typing possible. Phonetic identifier inputs, word analysis, and graphic shape analysis form a triad which cooperate to make automatic conversion of kana into kanji and the creation of natural-looking Japanese texts maximally efficient.

Figure 4B:
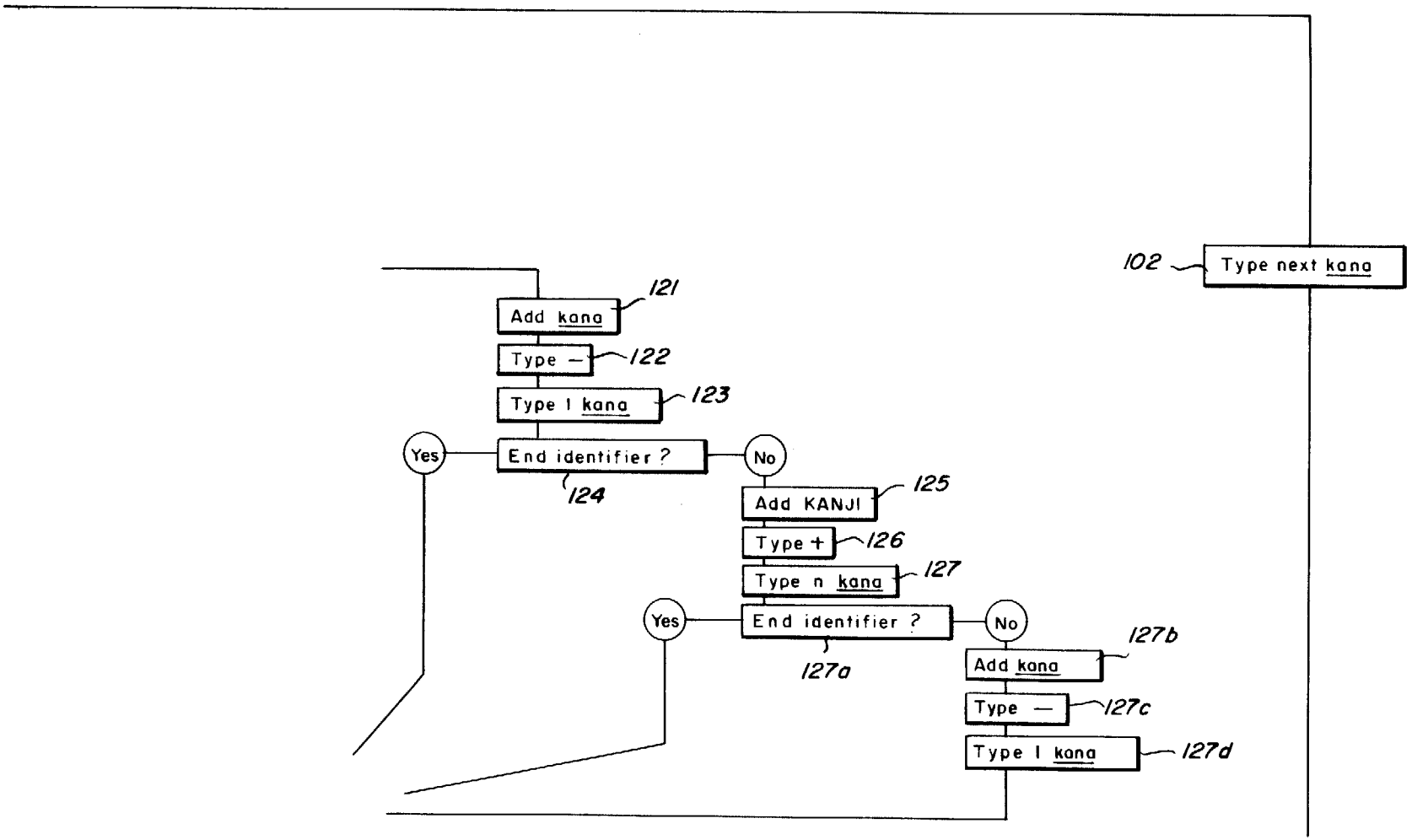

Referring now to FIGS. 4*a* and 4*b*, the operator of the system must first decide which syllabary is to be used. If hiragana is to be used, no shifting is required and the keyboard 2 as illustrated in FIG. 2 is used. If the English alphabet or if katakana are to be used, the appropriate function key (18 or 20) must be activated to change the mapping of the keyboard, and if kanji is required, then the conversion delimiter key 22 must be used.

In following the process of FIG. 4*a* and FIG. 4*b*, then, the first determination to be made by the operator is whether he wants a conversion from kana to kanji (see decision block 101 in FIG. 4*a*). If the answer is no, then the operator types the next kana, as indicated at function block 102, and the question of whether a conversion is wanted is repeated. If the answer is yes, the operator inputs the conversion delimiter, as indicated by "/" in function block 103 of the diagram. Selection of the conversion delimiter shifts the keyboard 2 from a "no wait" mode, wherein the typed kana are transferred directly to text, to a "wait" mode, wherein the system waits for the second conversion delimiter (/) of a pair before processing the input signals, as indicated at function block 104. This enables a typist to enter a string of kana for use in identifying kanji rather than for transfer to text.

After inputting the conversion signal /, the operator must decide, at block 105, whether he is inputting one of a small number of single-kanji suffixes. If he is, the add delimiter, indicated by "+" in the diagram, is typed in, as indicated at block 106, and the operator then inputs the desired number n of kana at block 107. The operator then inputs the second of the pair of conversion /, as indicated at function block 128, which then enables the system to seek the kanji identified by the delimited group of input kana. This input comprises an identifier which can be represented as /+k . . . /, where "k . . . " represents n number of kana. An identifier in this form represents a single kanji that normally occurs as a suffix.

Returning to the step represented in block 105, if the identifier to be input to the system does not represent a suffix, then instead of typing the add delimiter of block 106, the operator simply types the desired number of kana, as indicated in block 108. The operator must then decide, at decision block 109, whether he is finished inputting the desired identifier. If the answer is yes, then the conversion delimiter "/" is inserted, as at block 128. The identifier input at this point can be represented as /k . . . /, and it identifies a single kanji that normally occurs alone.

Returning to block 109, if the operator is not finished inputting the identifier, he must decide whether the portion of the identifier he is about to input represents another kanji or not, at decision block 110. If it does, then the add delimiter + is typed in, at block 111 and the operator again must decide whether he is inputting one of a small number of single-kanji prefixes at block 128. The identifier input at this point can be represented /k . . . +/, and it identifies a single kanji that normally occurs not alone, but as a prefix; i.e., is attached to the beginning of other words.

If the identifier is not a prefix, the decision at block 112 is no, and the operator then inserts n number of kana, as indicated at block 113. The operator must then decide whether he is finished inputting the identifier, at block 114 and if the answer is yes, the conversion delimiter "/" is input at block 128. The identifier input at this point can be represented as /k . . . +k . . . /, which identifies a two-kanji compound.

Returning to the decision block 114, if the operator is not yet finished inputting the identifier he is working on, he must decide whether the portion of the identifier he is about to input represents another kanji or not, as indicated at decision block 115. If the answer is yes, the operator types in the add function "+" at block 116, followed by n number of kana at block 117. Thereafter, the input "/" at block 128 is typed. The identifier input at this point can be represented /k . . . +k . . . +k . . . /, which identifies a three-kanji compound. Since it is contemplated that the present system memory will contain only two and three element kanji compounds, this process is not repeated in the preferred form of the invention.

Returning to block 115, if the identifier string to be input next by the operator is not to represent an additional kanji, but rather is to represent a kana suffix as indicated at block 118, the operator types in the terminal delimiter signal (indicated by "−" in the diagram) at step 119 and then inputs only one kana at block 120. This is followed by the delimiter "/" at block 128. The identifier input at this point can be represented as /k . . . +k . . . −k/, and it identifies two kanji followed by a kana suffix.

Returning now to decision block 110, where the operator decided whether the identifier he was working on was, at that stage, to represent two kanji or not, the results of an affirmative decision have already been described. However, if the decision at this point is "No" then the identifier must represent at least one kanji and one kana suffix, as indicated at decision block 121. The operator then must type in the terminal function "−" as indicated at block 122, followed by a single kana, as indicated at block 123. The operator then must decide whether he is finished inputting the identifier, as indicated at decision block 124. If so, the next input is the delimiter "/" at block 128, and the identifier at this point can be represented as /k . . . −k/, which identifies an inflected kanji (i.e., a kanji with a kana suffix).

If at decision block 124 it is determined by the operator that he is not finished with the identifier input, then the identifier must represent at least one kanji, one kana, and one more kanji, and accordingly an additional kanji must be added, as indicated at block 125. The operator then inputs the add function "+" at block 126 and types n number of kana, as indicated at block 127. Thereafter, the operator must decide whether he is finished inputting the identifier, as indicated at decision block 127*a*. If so, the next input is the interrupt function "/" at block 128, the identifier input at this point can be represented as /k . . . −k+k . . . /, which identifies a two-kanji compound wherein the initial kanji is inflected.

Returning to block 127*a*, if the operator is not through at this point, the identifier must represent a kanji, a kana, a kanji, and another kana at block 127*b*. Accordingly, operator inputs the terminal function "−" as indicated at block 127*c*, and a single kana is typed, as indicated at block 127*d*, followed by the interrupt function "/" at block 128. The identifier input at this point can be represented as /k . . . −k+k . . . −k/, which identifies a two-kanji compound, both of which are inflected.

In summary, the different kinds of identifiers that an operator can supply to the microprocessor 4 from the keyboard 2 are as follows:

| | |
|---|---|
| /+k . . . / | a kanji suffix |
| /k . . . +/ | a kanji prefix |
| /k . . . / | a single kanji that occurs alone |
| /k . . . +k . . . / | a two-kanji compound |
| /k . . . +k . . . +k . . . / | a three-kanji compound |
| /k . . . −k/ | an inflected kanji |
| /k . . . −k+k . . . / | a two-kanji compound the first of whose kanji is inflected |
| /k . . . +k . . . −k/ | a two-kanji compound with a kana suffix |
| /k . . . −k+k . . . −k/ | a two-kanji compound both of whose kanji are inflected |

Function block 128 represents the point at which the operator finishes inputting a phonetic identifier in the form of a combination of a string of kana input signals and delimiting function symbols for use in processing by the microprocessor 4. After the second delimiting signal "/" of a pair has been entered into the system, the microprocessor 4 begins, at block 129, to process the input string contained between the first and second interrupt delimiters to produce a corresponding addressing output signal $S_a$. This addressing signal $S_a$ is sent to the memory 6 to call up any kanji which correspond to the input string. The normal response of the memory 6 to an address signal is to produce an output signal corresponding to a single symbol or a string of symbols which are unique to the input kana identifier string. In such a case, the system incorporates this symbol or string of symbols directly into the text portion 8*a* of the display.

A possible response to the address signal, however, is the identification of more than one symbol or combination of symbols corresponding to the input kana identifier string. In this case the system displays the plurality of corresponding symbols for the operator as a list of numbered choices in the assembly portion of the display, without inserting any particularly item into the text. The operator then performs manual disambiguation by selecting the item he wants to have inserted into the text by using the numbers located on the keyboard.

Figure 4C:
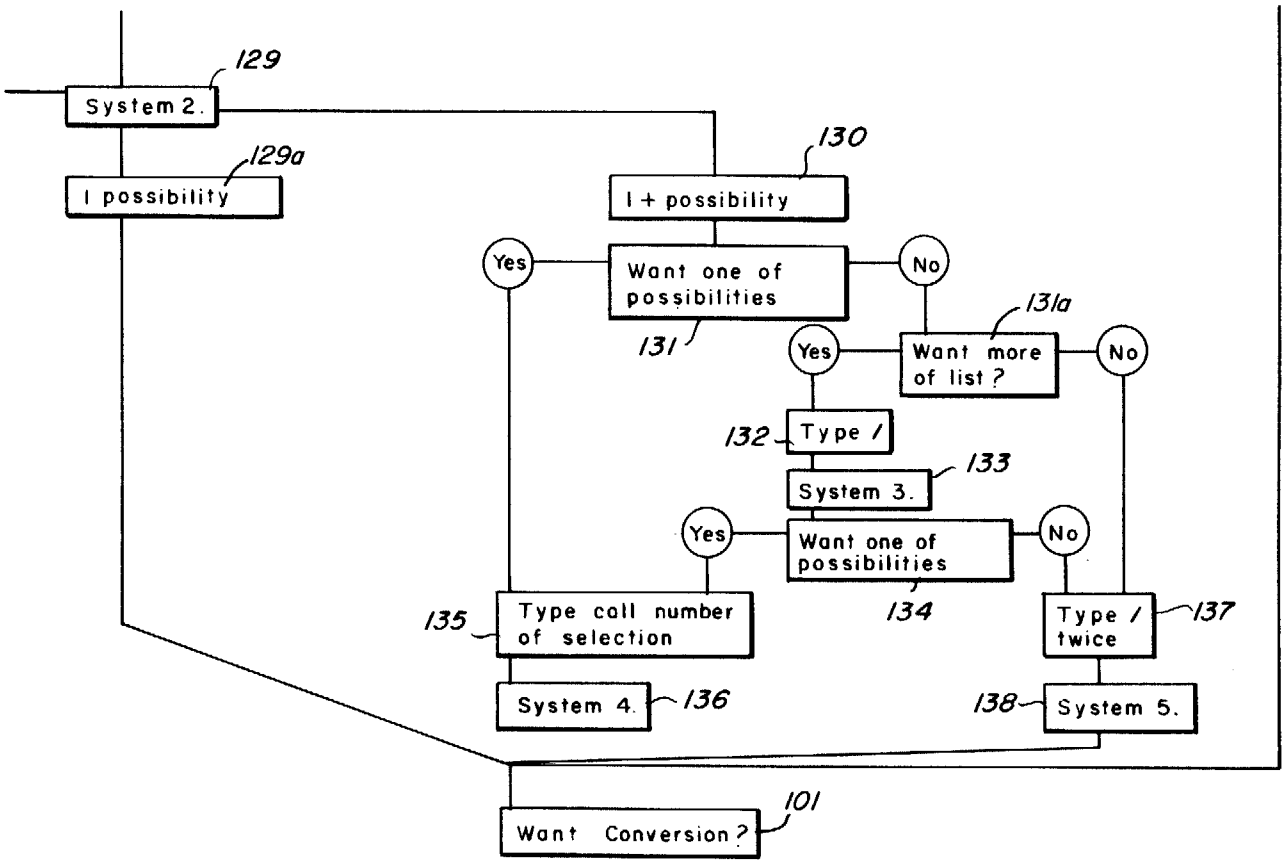
Figure 4D:
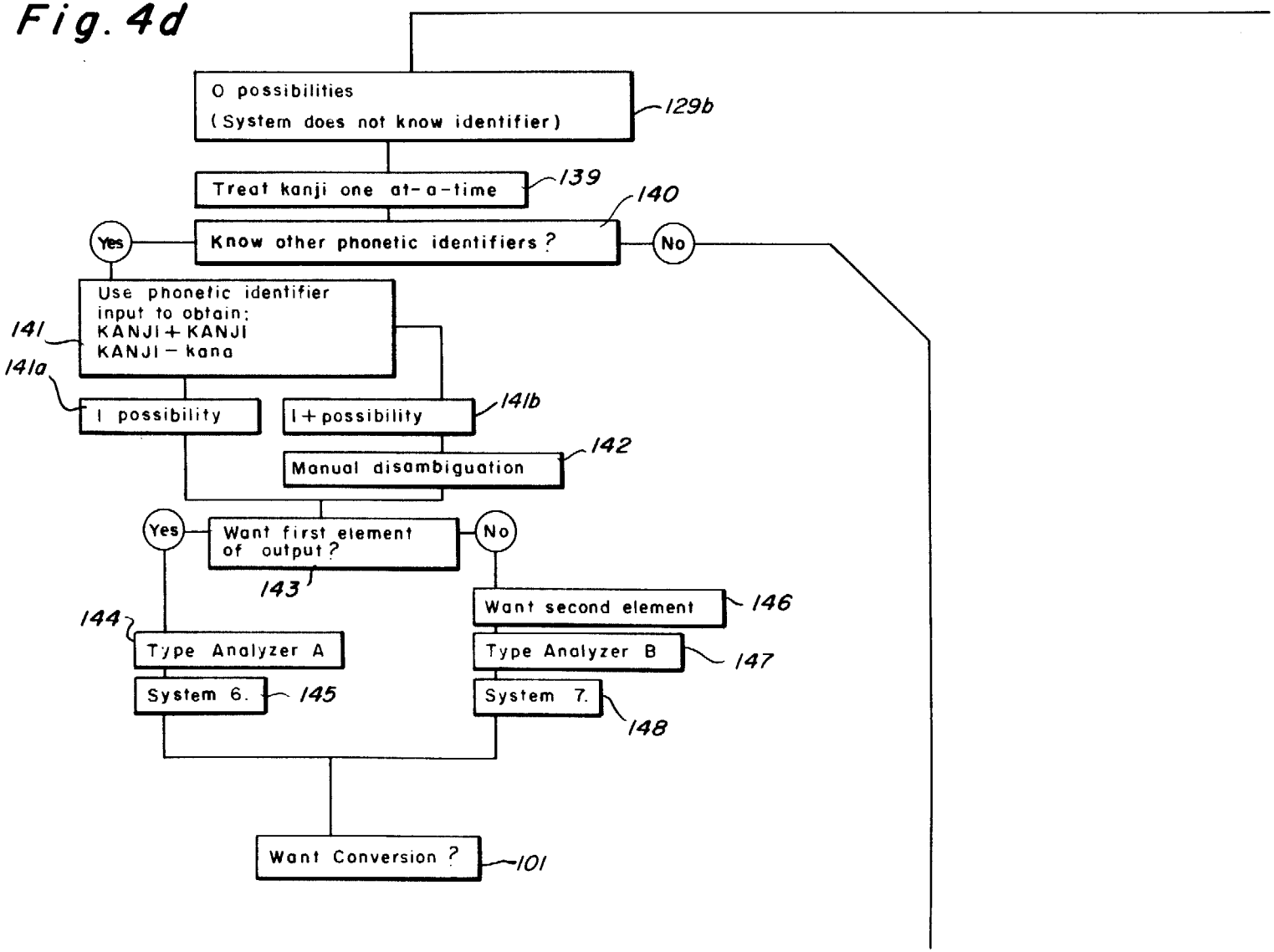
Figure 4E:
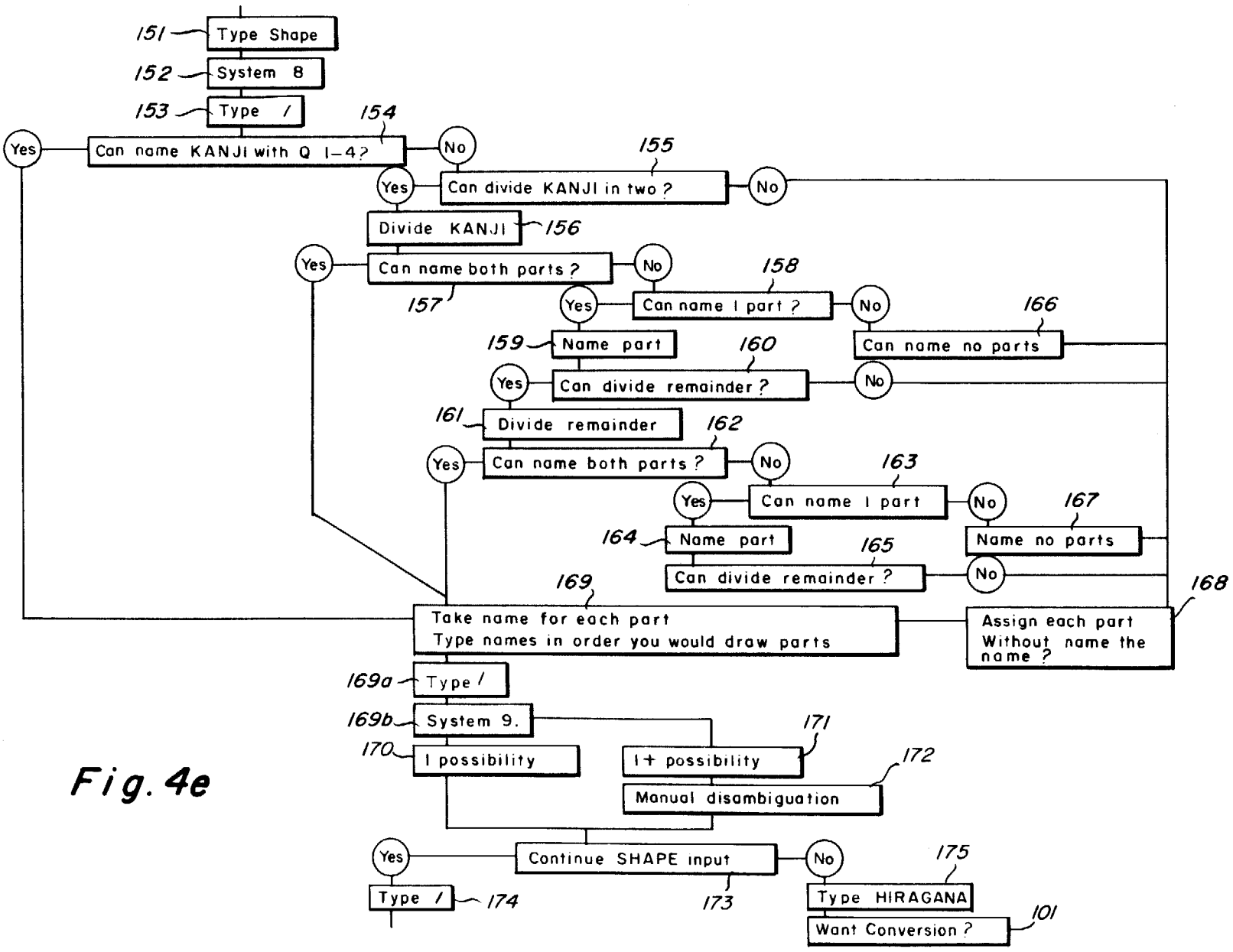

As indicated in FIGS. 4*c* and 4*d*, if the address signal generated by the system at step 129 produces only one kanji possibility, as indicated at step 129*a*, that single possibility is inserted directly into text, and the operator returns to the first decision block 101. If a list of possibilities is displayed, as indicated at block 130, the operator must decide whether he wants any of the possibilities shown, as indicated at decision block 131. If the answer is yes, the operator uses the numbers located on selector keys 28 of the keyboard of FIG. 3 to indicate his selection, typing the call number of the selection as indicated by block 135. This results in a system response, indicated at block 136, wherein the kanji selected by the call number is shifted into the text material being produced. Thereafter, the microprocessor 4 returns to the "no wait" kana input mode and the operator returns to the decision block 101.

If the decision at block 131 is that the operator does not want any of the possibilities displayed, the operator must decide to see more of the same list or not, as indicated at decision block 131*a*. If the list is a long one, the operator must cycle through it to find the selection he wants, and in this case he types the conversion delimiter key 22 to produce the delimiting signal "/" once, as indicated at block 132, to see more of the list. As indicated by function block 133, the system responds by displaying a second list of choices with identifying numbers and waits for operator response. The operator must then decide again whether he wants any of the possibilities displayed, as indicated at decision block 134. If the answer is yes, he inputs the call number of his choice as indicated at block 135, with the result previously described, and if not can either repeat the process of block 132 or can dispose of the list without making a selection from it by typing the conversion function "/" twice, as indicated at block 137.

Most lists produced by the memory 6 in response to an address are short enough to be viewed in their entirety without having to be cycled. In such a case, the process indicated by block 132 is not necessary, for an operator can tell after a quick inspection that the system is unfamiliar with the identifier string he has supplied, and he can then turn to alternate input strategies. In this case, the response to decision block 131*a* is no, and the operator inputs the conversion function "/" twice, as indicated at block 137. This disposes of the list without making a selection from it and, since none of the displayed kanji have been selected, the microprocessor 4 returns to the "no wait" kana input mode as indicated at function block 138.

The selection of items from lists, as described above, is referred to as "manual disambiguation". It involves the operator making unambiguous choices by way of keyboard numbers which correspond to items in displayed lists. On the other hand, automatic disambiguation occurs when the system itself makes unambiguous choices based on the information which the operator includes in an identifier string. When the system can make an unambiguous choice, that choice is inserted directly into the text material.

The delimiter signals provided in the identifier string are provided to facilitate automatic disambiguation. However, delimiters cannot make all identifier strings unambiguous, and for this reason manual disambiguation must be provided. The delimiters assist in manual disambiguation, however, by making the lists which the system provides short and homogeneous, so that the operators do not have to cycle through long lists of miscellaneous alternatives and do not have to carefully study the screen display as they try to make selections. Short homogeneous lists can be easily learned through familiarity, making selection without reference to the display possible, and facilitating true touch-typing.

Returning now to function block 129, it occasionally happens that an identifier string will produce no corresponding stored symbols in the memory 6, as indicated at function block 129*b* (FIG. 4*d*). In this case, the operator can try an alternate kana identifier string input with the form /k . . . / to see if the system will respond to that form. If not, the operator must then resort to one of the alternate input strategies previously described in order to insert the desired item into text, beginning with the process indicated at function block 139.

The operator first examines a single kanji which he is seeking to type, as indicated at function block 139, and decides whether he knows any other phonetic identifiers that contain this kanji, as indicated at decision block 140. If other phonetic identifiers are known, then word analysis procedures can be used, as indicated at function block 141. Word analysis works on two-element compounds, one element of which is the kanji an operator obtain by normal identifier input. Thus, the operator creates a kana identifier string for a two-element compound having the form /k . . . +k . . . /, or the form /k . . . −k/.

In performing word analysis, the operator can also try alternate input identifier forms such as /k . . . +k . . . +k . . . /, /k . . . +k . . . −k/, /k . . . −k+k . . . /, or /k . . . −k+k . . . −k/. These identifiers can produce symbols that have two or more elements in them, and word analysis can be applied to such outputs. Three or four element compounds are first reduced to two-element compounds before the following steps are applied.

The system responds to the foregoing word analysis input identifier string by looking up and displaying all items that are identified. If there is only one possibility, as indicated at function block 141*a*, that item is inserted directly into the text. If there are more than one, as indicated by block 141*b*, these items are listed in the assembly portion 8*b* of the CRT display for manual disambiguation by the operator, as indicated by function block 142. The operator then selects the item he wants and it is inserted into the text. However, since the item now in the text is not yet the exact kanji which was to be typed, but is instead a two-element compound which contains the desired kanji, the operator must examine the item just inserted into the text and determine whether he wants the first element of the compound, in accordance with decision block 143. If the answer is yes, the operator strikes the word analysis delete function key 30 (FIG. 3) as indicated by function block 144. With the keyboard 2 arranged as illustrated, the operator would normally use his right index finger for this operation.

As indicated at function block 145, the system responds to the input from key 30 to delete the last character of the compound just inserted in the text. This is accomplished by deleting the signal corresponding to that display from the text buffer diagrammatically illustrated at 145' in FIG. 1 in the microprocessor 4, thereby erasing the character from the display. This would complete the insertion of the desired kanji symbol into the text, and the system would return to the initial decision block 101.

However, if the answer to decision block 143 is no, and the operator does not want the first element of the compound, it follows that he would want the second element, as indicated by function block 146.

In this case, the operator would select word analysis delete function key 32 (FIG. 3) as indicated in block 147, normally using the second finger of his right hand in the keyboard layout of that figure. Thereafter, the system deletes the second-to-last character in the text buffer 145' of the microprocessor 4 to thereby erase the character from the display, as indicated in block 148. The result of operating word analysis delete function keys 30 or 32 on a two-element compound is the inclusion of only the desired kanji in the text which the operator is creating. Thereafter, the system returns to block 101.

Returning to decision block 140, if upon examining a kanji to be typed, the operator cannot produce alternate phonetic identifiers that contain the kanji, or cannot find such identifiers through word analysis, the operator can elect to use a graphic shape analysis to obtain the desired kanji. Thus, if the answer to decision block 140 is no, the operator signals his choice by striking the shape key 36, as indicated by the function block 151. From the operator's point of view, the system is now ready to accept graphic identifiers instead of phonetic identifiers in accordance with the shape mode indicated by function block 152. The mapping of the keyboard stays the same, but the microprocessor 4 itself shifts to incorporate a graphic identifier in the identifier buffer diagrammatically illustrated at 152' in FIG. 1. The microprocessor 4 is then in the kanji shape mode, and the operator inputs the conversion function "/", as indicated at block 153. The operator then examines the graphic configuration of the kanji to be input in order to determine an identifier string for it. The operator first looks at the kanji as a whole and applies four ordered questions to it, as indicated in decision block 154. These questions are:

(1) Is what he sees a katakana or a number?
(2) Does what he sees have a common kun reading? (Only kun readings without okurigana are acceptable.)
(3) Does what he sees have a common on reading?
(4) Is what he sees a member of a small set of well-known kanji radicals?

Kun, on and okurigana are terms that denote certain categories of sound-shape correlation, and are well-known to Japanese-speaking operators. If the answer to any of these questions is yes, the operator names the kanji he is examining in accordance with that question, inputs that name by means of the kana keyboard, as indicated in function block 169, and then inputs the second interrupt function "/" as indicated at block 169*a*.

Returning to block 154, if the answer to all of the questions is no, the operator must then decide whether the kanji being examined can be divided into two parts (decision block 155). If the answer is yes, this done at function block 156 and the operator then decides whether he can name both of these parts according to questions 1–4, at decision block 157. If the answers to questions to 1–4 for each part of the kanji results in names for both parts, the operator inputs these names via the kana keyboard in the order that the parts would be drawn when written with pencil and paper, as indicated at function block 169. Then the terminating interrupt function "/" is input, as indicated at 169*a*.

Returning to block 157, if the operator cannot name both parts, he must decide whether he can name one part, in accordance with decision block 158. If the answer is yes, this is done at block 159 and a further decision is made at block 160 as to whether the remainder can be divided in two, in accordance with function block 160. If the remainder can be divided, this is done at block 161 and the question is again asked at block 162 whether both parts can be named according to questions 1 to 4. If the answer is yes, then the names are typed in accordance with block 169. If not, then decision block 163 is followed. Steps 162 through 165 duplicate steps 157 through 160, already described. The operator continues to divide unnamable parts in two, name as many parts as he can with questions 1 to 4, then redivide the unnamable residue until further redivision becomes impossible, as indicated at decision block 155. For the sake of simplification, FIG. 4*e* includes only one repetition of steps 157 through 160, but it will be understood that analysis of more complicated kanji may require further repetitions of these steps.

Returning to step 155, at which the operator first decides whether he can divide the kanji designated for graphic input into two parts, the decision at this point may be no. In such a case, the operator assigns the kanji the generic name "?", at function block 168, which symbol is obtained by striking key 38 in FIG. 2. The generic name "?" is used for parts of kanji that cannot be named using questions 1-4. In this case, it designates a whole kanji that can neither be named nor divided. Since there are no other parts to be named or divided, the operator then inputs the interrupt function "/" at block 169*a*.

Returning to step 158, at which the operator decides whether he can at least name one of the two parts into which he has divided the kanji, the answer may be no. In this case, there are no parts that can be assigned names according to questions 1 to 4, as indicated at block 166, but there are two parts of the kanji to which the generic name "?" can be assigned at block 168. The operator inputs the two generic names at block 169, and then inputs the interrupt function "/" at block 169*a*.

Step 167 is a repeat of step 166 but occurs after the operator has divided a kanji, named one part, and then divided the unnamable remainder. The operator may find that he can name neither of these two remainder parts with questions 1-4, and accordingly the generic name "?" is assigned to these parts. At block 168, the names of all the parts they have identified are input at block 169, and the interrupt function "/" is supplied at block 169*a*.

Step 169*a* is the point at which operator hands over the shape identifier to the system for processing, and when the interrupt function is typed, the microprocessor 4 responds, at block 169*b*, in the manner previously described with respect to block 129. Thus, the system responds to the input of named parts (or radicals) of the kanji by looking up and displaying all items that are identified by the identifier string. If there is only one identified item, that item is inserted directly into text, as indicated at block 170. If there is more than one item produced by the identifier, as indicated at block 171, those items are listed for manual disambiguation in accordance with the function block 172. In accordance with this block 172, the operator selects the item he wants and it is inserted into text. At this point the operator may or may not want to continue with the shape input, at block 173. If so, the operator proceeds to input a conversion function "/" at block 174. If the operator does not wish to continue the shape input, he presses the hiragana function key 16, as indicated at block 175 so that the system returns to the no wait mode at function block 101, and the process begins anew.

Many commercially available hardware units may be used and various processing algorithms and programs may be employed to practice the present invention. In a preferred embodiment, the microprocessor 4 is of the type called "Tarak" and the programming language used to perform the desired algorithm is called "RATFOR", which is a structured language built on FORTRAN. Appendix A is a list of instructions for carrying out the present invention in accordance with such a program.

While in accordance with the provisions of the patent statutes the preferred forms and embodiments of the invention have been illustrated and described hereinabove, it will become apparent to those skilled in the art that various changes and modifications may be made without deviating from the true spirit and scope thereof as set forth in the following claims:

What is claimed is:

1. Apparatus for typing Japanese text material which incorporates hiragana, katakana, kanji and English alphabet syllabaries, comprising:

a hiragana keyboard having plural keys selectively mapped in hiragana, katakana and English alphabet syllabaries, said keyboard producing kana identifier signals corresponding to selected keys in said hiragana or katakana mapping;

function shift means for selectively changing the mapping of said keyboard to shift between hiragana, katakana and English alphabet mapping;

at least three delimiter signal means on said keyboard producing delimiter signals for use in automatic solution of ambiguities;

selector keys on said keyboard for manual resolution of ambiguities;

memory means including selected kanji symbols and lists of selected kanji symbols retrievable by address signals;

microprocesor means connected to said keyboard and to said memory means and responsive to specified sequences of kana identifier signals and delimiter signals from said keyboard to produce address signals, said address signals calling up from said memory means corresponding kanji symbols or lists of symbols, said microprocessor means being further responsive to specified kana identifier signals alone to produce corresponding kana outputs; and display means responsive to said kana outputs to produce a text display of the kana corresponding thereto, and being further responsive to said microprocessor to display said kanji symbols or lists of symbols called up from said memory means, said delimiter signals providing automatic disambiguation of lists of kanji symbols corresponding to said input kana identifier signals from said keyboard and said selector keys on said keyboard providing manual disambiguation of lists of kanji symbols.

2. The apparatus of claim 1 wherein a first of said delimiter signal means includes means producing a conversion delimiting signal for selecting kana to kanji conversion.

3. The apparatus of claim 2, wherein a second of said delimiter signal means includes means producing an add function delimiting signal for identifying kanji compounds.

4. The apparatus of claim 3, wherein a third of said delimiter signal means includes means producing a terminal function delimiting signal for defining a kana suffix of a kanji symbol.

5. The apparatus of claim 1, wherein one of said delimiter signal means includes means producing a terminal function delimiting signal for defining a kana suffix of a kanji symbol, whereby input kana identifier signals preceding a terminal function delimiting signal call up from said memory means a corresponding list of kanji, while input kana identifier signals following said terminal function delimiting signal select from said called-up list any kanji which may be combined with said kana suffix to reduce ambiguities.

6. The apparatus of claim 1, wherein one of said delimiter signal means includes means producing an add function delimiting signal for identifying kanji compounds, to thereby reduce ambiguities.

7. The apparatus of claim 1, further including word analysis means for selecting desired kanji from said memory, said word analysis means including at least one delete function key on said hiragana keyboard, whereby portions of kanji symbols can be selectively deleted to produce a desired kanji symbol.

8. The apparatus of claim 1, further including shape analysis means for selecting desired kanji from said memory, said shape analysis means including:

kanji symbols in said memory means identified by the shape of the strokes or stroke groups in said kanji symbols and retrievable by shape address signals; and shape key means on said hiragana keyboard, said microprocessor means being responsive to input signals from said shape key means and a following sequence of kana identifier signals from said keyboard corresponding to the kana names of the strokes or stroke groups of a desired kanji symbol to produce a shape address signal to call up from said memory means a desired kanji symbol.

9. Apparatus for typing Japanese text, comprising:

(a) keyboard means including (1) a plurality of kana keys;

(2) function shift keys for selectively changing the mapping of said kana keys whereby said kana keys produce input signals corresponding to hiragana, katakana or English alphabet symbols, when said kana keys are operated; and (3) conversion, add function and terminal function delimiting keys selectively operable to produce conversion, add, and terminal delimiting signals, respectively;

(b) addressable memory means storing a plurality of Japanese kanji symbols;

(c) microprocessor means connected with said keyboard means for processing said kana keys to produce corresponding kana output signals, said microprocessor means further processing combinations of delimiting signals and input signals from said kana keys to produce addressing output signals, wherein (1) successive conversion delimiting signals are operable to delineate groups of kana input signals which are to be converted to kanji symbols, (2) said add function delimiting signals are operable to delineate groups of kana input signals which correspond to kanji compounds; and (3) said terminal function delimiting signals are operable to delineate groups of kana input signals which correspond to kana suffixes for kanji symbols;

(d) said memory means being operable in response to said addressing output signals to produce kanji output signals corresponding to the addressed kanji symbols stored therein; and (e) display means for displaying kana and kanji symbols in response to said kana and kanji output signals, respectively.

10. The apparatus of claim 9, further including printer means connected with said microprocessor means for printing the symbols displayed on said display means.

11. A method of typing Japanese text material in hiragana, katakana, English alphabet and kanji syllabaries from a keyboard connected through a microprocessor to an addressable memory and to a display, the keyboard having kana keys, means for changing the mapping of the kana keys, and a plurality of delimiter keys, the method comprising:

storing a plurality of kanji symbols in said memory;

selecting a desired mapping for said kana keys;

selectively operating a plurality of said kana keys to produce a plurality of kana input signals;

selectively operating one or more of said delimiter keys to produce conversion, add function and terminal function delimiter input signals;

processing kana input signals to produce kana output signals;

processing combinations of kana input signals and delimiter input signals to produce addressing output signals wherein (a) successive conversion delimiter input signals are operable to delineate kana input signals which are to be converted to corresponding kanji symbols;

(b) said add function delimiter input signals are operable to identify kana input signals which correspond to kanji compounds; and (c) said terminal function delimiter input signals are operable to identify kana input signals which correspond to kanji suffixes;

addressing said memory with said addressing output signals to produce kanji output signals from said memory corresponding with the addressed kanji symbols stored therein; and displaying kana and kanji symbols in response to said kana and kanji output signals, respectively.

12. The method of claim 11, further including:

selectively operating word analysis keys on said keyboard to delete undesired portions of displayed kanji symbols.

13. The method of claim 11, further including selectively operating a shape key on said keyboard to produce shape analysis input signals;

processing combinations of kana input signals and shape analysis input signals to produce shape address signals wherein the kana input signals name the strokes or groups of strokes present in the selected kanji symbols; and addressing said memory with said shape address signals to produce kanji output signals corresponding with the addressed kanji symbols stored therein.

* * * * *

UNITED STATES PATENT AND TRADEMARK OFFICE

CERTIFICATE OF CORRECTION

PATENT NO. : 4,544,276

DATED : 1 October 1985

INVENTOR(S) : Richard A. Horodeck

It is certified that error appears in the above—identified patent and that said Letters Patent is hereby corrected as shown below:

IN THE CLAIMS:

CLAIM 1, line 37, change "solution" to --resolution--.

Signed and Sealed this

*Twenty-first* Day of *January 1986*

[SEAL]

*Attest:*

DONALD J. QUIGG

*Attesting Officer*

*Commissioner of Patents and Trademarks*